US005735516A

United States Patent [19]

Gerlier et al.

[11] Patent Number: 5,735,516

[45] Date of Patent: Apr. 7, 1998

[54] APPARATUS FOR HANDLING SHEETS

[75] Inventors: Andre Gerlier, Sciez, France; Roberto Polidoro, Geneva, Switzerland

[73] Assignee: Mars Incorporated, McLean, Va.

[21] Appl. No.: 336,510

[22] Filed: Nov. 9, 1994

Related U.S. Application Data

[63] Continuation-in-part of Ser. No. 54,888, Apr. 30, 1993, abandoned.

[30] Foreign Application Priority Data

May 27, 1992 [CH] Switzerland ..... 1716/92

[51] Int. Cl.[6] ..... B65H 39/00

[52] U.S. Cl. ..... 270/60; 209/534; 271/213; 271/303; 414/789.9

[58] Field of Search ..... 270/60; 271/213, 271/176, 303; 414/789.9; 209/534

[56] References Cited

U.S. PATENT DOCUMENTS

| | | | |
|---|---|---|---|
| 2,278,188 | 3/1942 | Bamford et al. . | |
| 3,026,023 | 3/1962 | Hirschfeld . | |
| 3,064,785 | 11/1962 | Weingart . | |
| 3,083,012 | 3/1963 | Poland . | |
| 3,108,694 | 10/1963 | Crain et al. . | |
| 3,162,439 | 12/1964 | Poland et al. . | |
| 3,222,057 | 12/1965 | Couri . | |
| 3,265,205 | 8/1966 | Chumley . | |
| 3,272,044 | 9/1966 | Obenshain . | |
| 3,345,923 | 10/1967 | Erk | 270/60 |
| 3,426,879 | 2/1969 | Walker . | |
| 3,447,655 | 6/1969 | Tanaka et al. . | |
| 3,481,464 | 12/1969 | Townsend | 209/534 |
| 3,614,087 | 10/1971 | Zernov | 270/60 |
| 3,632,105 | 1/1972 | Verhoeven . | |
| 3,683,943 | 8/1972 | De Crepy | 271/301 |
| 3,888,267 | 6/1975 | Gautschi | 270/60 X |
| 3,935,933 | 2/1976 | Tanaka et al. . | |

(List continued on next page.)

FOREIGN PATENT DOCUMENTS

| | | |
|---|---|---|
| 1310023 | 10/1992 | Canada . |
| 0131812 | 1/1985 | European Pat. Off. . |
| 0148310 | 7/1985 | European Pat. Off. . |
| 0174009 | 3/1986 | European Pat. Off. . |
| 0194139 | 9/1986 | European Pat. Off. . |
| 0395047 A2 | 10/1990 | European Pat. Off. . |
| 0395047 A3 | 10/1990 | European Pat. Off. . |
| 0 471 578 A2 | 2/1992 | European Pat. Off. . |
| 0 575 711 A1 | 12/1993 | European Pat. Off. . |
| 1271264 | 7/1960 | France . |

(List continued on next page.)

OTHER PUBLICATIONS

Landis & Gyr brochure entitled "Systeme de Traitment de Billets de Banq BSN 385/39/35" published Sep. 1991. A copy of an English translation is enclosed.

German disclosure RD 248020 Dec. 1984.

*Primary Examiner*—Hoang Nguyen

*Attorney, Agent, or Firm*—Fish & Richardson P.C.

[57] ABSTRACT

Apparatus is described for handling sheets, such as bank notes or other value sheets. An inserted note is transported to an intermediate position in which the note can either be rejected or encashed without affecting notes already stored on a temporary storage drum, or the note can be stored on the temporary storage drum from the intermediate position. The intermediate position may be in an output path of the apparatus and the note reversed on to the drum, the intermediate position may be a partially stored position of the note on the drum, from which the note can be discharged without discharging any additional notes already stored on the drum. A selectable transmission coupling is used to rotate the drum from a common drive source in one direction for storing successive notes as a bundle, and in a reverse direction of discharging the bundle. A passive guide is biased towards the drum to lift sheets off the drum when the drum in the reverse direction, and a sensor switch monitors the position of the guide means to determine when a discharge operation can be performed.

54 Claims, 19 Drawing Sheets

U.S. PATENT DOCUMENTS

| | | | |
|---|---|---|---|
| 4,168,058 | 9/1979 | Granzow et al. . | |
| 4,193,685 | 3/1980 | Rudy et al. . | |
| 4,363,584 | 12/1982 | Kokubo . | |
| 4,441,701 | 4/1984 | Beentjes et al. . | |
| 4,462,509 | 7/1984 | Adelberger . | |
| 4,468,021 | 8/1984 | Weber . | |
| 4,482,057 | 11/1984 | Shawen et al. . | |
| 4,540,081 | 9/1985 | Mori et al. | 209/534 X |
| 4,552,350 | 11/1985 | Nagy et al. . | |
| 4,557,352 | 12/1985 | Tschappat, Jr. . | |
| 4,578,009 | 3/1986 | Granzow et al. . | |
| 4,585,144 | 4/1986 | Granzow et al. . | |
| 4,624,359 | 11/1986 | Gross . | |
| 4,625,870 | 12/1986 | Nao et al. | 209/534 |
| 4,697,944 | 10/1987 | Peebles et al. . | |
| 4,699,374 | 10/1987 | Hain . | |
| 4,747,493 | 5/1988 | Nakanishi | 209/534 |
| 4,807,736 | 2/1989 | Kondo et al. . | |
| 4,822,018 | 4/1989 | Hain | 270/60 X |
| 4,858,744 | 8/1989 | Dolejs et al. . | |
| 4,871,085 | 10/1989 | Graef et al. . | |
| 4,880,096 | 11/1989 | Kobayashi et al. . | |
| 4,889,240 | 12/1989 | Sato et al. | 209/534 |
| 4,922,109 | 5/1990 | Bercovitz et al. . | |
| 5,064,074 | 11/1991 | Edin et al. . | |
| 5,222,584 | 6/1993 | Zouzoulas . | |

FOREIGN PATENT DOCUMENTS

| | | | |
|---|---|---|---|
| 2453811 | 4/1979 | France . | |
| 2545462 | 11/1984 | France . | |
| 2621305 | 4/1989 | France . | |
| 1942845 | 3/1970 | Germany . | |
| 2028649 | 6/1970 | Germany . | |
| 2064724 | 7/1972 | Germany . | |
| 2157379 | 5/1973 | Germany . | |
| 2431569 | 7/1974 | Germany . | |
| 2336335 | 12/1974 | Germany . | |
| 2408584 | 8/1975 | Germany . | |
| 2619620 | 1/1977 | Germany . | |
| 2760165 C2 | 7/1977 | Germany . | |
| 2921688 | 11/1980 | Germany | 209/534 |
| 3830339 | 3/1989 | Germany . | |
| 3931571 A1 | 3/1991 | Germany . | |
| 407 178 | 8/1966 | Switzerland . | |
| 558 575 | 1/1975 | Switzerland . | |
| 658736 | 11/1986 | Switzerland . | |
| 661603 | 7/1987 | Switzerland . | |
| 1510934 | 5/1978 | United Kingdom . | |
| 2054534 | 2/1981 | United Kingdom . | |
| 2110188 | 6/1983 | United Kingdom . | |
| 2142320 | 1/1985 | United Kingdom . | |
| 2197300 | 5/1988 | United Kingdom . | |
| 2209518 | 5/1989 | United Kingdom . | |
| WO 93/21609 | 10/1993 | WIPO . | |

APPARATUS FOR HANDLING SHEETS

This application is a continuation in part of U.S. patent application Ser. No. 08/054,888, filed on the 30 Apr. 1993, now abandoned, and claiming priority from Swiss patent application no. 1716/92-3 (filed on 27 May 1992).

FIELD OF THE INVENTION

The invention relates to apparatus for handling sheets such as banknotes, and in one aspect to a short-term or temporary storage device, or "escrow" device, for use in such apparatus. Such an escrow device is suitable for storing banknotes at an intermediate stage in the processing of the banknotes, after which the banknotes can be returned to the user, or encashed by the apparatus. For example, an escrow device can be used in the banknote reading apparatus of an automatic vending machine or an automatic currency exchange machine, for temporarily storing introduced banknotes until a desired service is requested by the user or, if a cancellation request is received, until the previously introduced banknotes are returned.

DESCRIPTION OF PRIOR ART

Reference is made to the accompanying FIGS. 5–7 of the drawings which illustrate a known banknote handling system including an escrow. This system was produced by Landis & Gyr, and was used in Europe from 1982 under the product references BSN 30/32/34. A similar system was also used in the United States from 1987.

In FIG. 5, the system consists of three separate units, namely a validator unit 310, an escrow and piston stacker unit 312, and a vault 314. The route of a banknote in the system is shown schematically in FIG. 5, and detail of the transportation mechanism for the escrow/stacker unit 312 is shown in FIGS. 6 and 7.

Referring to FIG. 5, a note introduced into the validator unit 310 is guided along the path shown by the broken line 316, and around a drum (not shown) at which stage the note is sensed by sensors 318. Depending on whether the note is found to be acceptable, the note is routed by a switch 320 either to a single note reject slot 322 if unacceptable, or downwardly into the escrow/stacker unit 312 if acceptable.

Referring to FIGS. 6 and 7, the escrow consists of a rotatable drum 324 around which notes are stored as a temporary stack. A set of parallel, endless belts 326 (only one belt 326 is visible in the drawings) extends around a major portion of the circumference of the drum 324, leaving clear an entry/exit area 328 through which notes are introduced to, or discharged from, the drum 324. Notes are guided on to the drum 324, and are selectively guided around the drum 324, or are selectively discharged from the drum 324, by means of a first set of selectors 330 and a second set of selectors 332 (only one selector 330, 332 from each set is visible in FIGS. 6 and 7). Each selector 330, 332 includes a finger 334, and is pivotally movable between an activated position in which the finger 334 is pushed against the surface of the drum 324 (see FIG. 6), and a non-activated position in which the finger 334 is spaced from the surface of the drum 324 (see FIG. 7). The surface of the drum 324 is formed with annular recesses in which the fingers 334 are received when they are pushed against the drum, such that the ends of the fingers 334 sit below the outermost surface of the drum on which the notes are stored. The selectors 330 and 332 are operated together by a common actuator linkage (not shown) which moves the selectors 330 and 332 in unison between the activated and non-activated positions.

A drive unit (not shown) drives the drum 324 through the belts 326, and is operable to rotate the drum in either a forward direction (anti-clockwise in the drawings), or a reverse direction (clockwise in the drawings). In use, when a note arrives from the validator unit 310, the drum 324 is driven in the forward direction, and the selectors 330 and 332 are set to the non-activated position. The note is guided towards the drum 324 by belts 336 and 338, and is directed to the left under the fingers 334 of the first selectors 330 and on to the surface of the rotating drum, such that the note is stored between the drum 324 and the belts 326. Each successive individual note from the validator unit 310 is fed to the drum 324 in a similar manner such that each new note is laid on top of notes already stored on the drum as the new note meets the existing notes at the entry/exit area 328, whereby the notes are accumulating as a stack.

If, for any reason, the stack of notes accumulated on the drum 324 has to be returned to the user, the selectors 330 and 332 are set in the activated position and the drum 324 is rotated in the reverse direction. The stack of notes is lifted off the surface of the drum 324 as the leading edge of the stack engages and rides up the fingers 334 of the first selectors 330, and the stack is directed by guides (not shown) and belts 340 and 326 to a stack exit slot 342.

When the stack of notes accumulated on the drum is to be encashed, the selectors 330 and 332 are set in the activated position, and the drum 324 is rotated in the forward direction. The stack of notes is lifted off the surface of the drum 324 as the leading edge of the stack engages and rides up the fingers 334 of the second selectors 332, and the stack is directed by guides (not shown) and belts 326 and 338 towards a stacking position under a piston 344. When the stack reaches that position, the piston 344 is operated to push the stack downwardly into the vault 314.

Reference is also made to U.S. Pat. No. 4,822,018 (Hain) which describes a cash dispenser including a sheet stacking mechanism for accumulating currency notes into a stack before the notes are delivered to a customer. In that system, a stacking cylinder is rotated continuously, and notes have to be fed to the cylinder at certain synchronized time points so that the notes will reach the cylinder at an appropriate moment to be stacked in alignment with notes already stored on the cylinder. A moveable guide has to be controlled by a stepping motor to lift the stack off the cylinder when the cylinder is operated in a reverse direction of rotation.

A short-term storage device for banknotes is also known from German laid-open application (DE-OS) No. 26 19 620, which, for storage of the banknotes, has an intermediate storage device and a waiting position into which the newly introduced and checked banknote is initially conveyed, while the banknotes which have possibly been previously collected in the intermediate storage device are pushed in the form of a bundle out of the intermediate storage device and transported simultaneously with the new banknote into the first waiting position so that the bundle is increased in size by that one new banknote. The bundle is then pushed back again in the reverse transportation direction out of the first waiting position into the intermediate storage device or returned to the customer or conveyed into the cash box.

The short-term storage device disclosed in Swiss Patent Specification No. 558 575 serves for the short-term storage of sheets of paper, for example banknotes, on the internal wall of a semi cylindrical member, the feed being from the inside of the semi cylindrical member. The newly supplied sheet is deposited on the bundle which has collected at the internal wall of the semicylindrical member. That arrangement does not involve the bundle being pushed to and fro in the storage procedure. Return is effected by means of a pushing device, with the sheets of different dimensions being aligned with respect to the rearward edge of the bundle.

German laid-open application (DE-OS) No. 20 28 649 discloses a short-term storage device with an intermediate storage device formed by a motor-driven cylinder which rotates in one direction of rotation. The banknotes are stored by way of a feed passage between the belts and the surface of the cylinder, wherein the banknotes are successively deposited on the cylinder in displaced relationship through a small angle in the transportation direction, and are held there by the belts. The storage device is full as soon as the spacing between the leading edge of the first banknote and the trailing edge of the last banknote introduced has reached a portion of the periphery of the cylinder, which is defined by light barriers. Two electrically operated switching devices are disposed in diametrally opposite relationship to the input of the intermediate storage device and can guide the banknotes tangentially away from the cylinder. The one switching device points the banknotes to the cash box while the other points them into a return passage. The banknotes are not bundled but lie one over the other in displaced relationship in the direction of transportation movement when they are transported away.

A similar problem which arises in the printing art is solved by the apparatus for bundling sheets of paper, which is described in U.S. Pat. No. 2,278,188. The sheet of paper is deflected by means of a single switching device on to a rotating cylindrical member. The sheet is aligned with its leading edge to the leading edge of the bundle which rotates with the cylinder and which has been formed from sheets which have already arrived previously. During the revolution of the cylinder which now follows, the sheet is deposited on the bundle. As soon as the bundle comprises a predetermined number N of sheets, the following sheet of paper is admittedly aligned with respect to the bundle, but the switching device deflects the total bundle with N+1 sheets from the cylinder into a catch dish or for further processing.

SUMMARY OF THE INVENTION

The invention relates generally to apparatus including an escrow, or temporary or short term storage device, for sheets such as value sheets, (e.g. banknotes or sheets treated as having a value). In some designs, the escrow may comprise a rotatable drum or cylindrical means around which one or more sheets are stored as a temporary stack, and endless belt means extending around a major portion of the circumference of the drum. However, other general aspects of the invention are not limited to this.

In one aspect, the invention relates to a movable guide for guiding sheets (such as banknotes) on the surface of the drum. One preferred feature is that the guide is resiliently biased towards a normal position relative to the drum in which a lifting end of the guide sits below or flush with the surface of the drum on which notes are accumulated. During rotation of the drum in a first, stacking direction, the leading edges of notes held by the belt means on the drum bear against the guide from the rear, and automatically displace the guide outwardly against the bias to allow the notes to pass under the guide. Once the tail edges of the notes have cleared the guide, the guide springs back to its normal position. On rotating the drum in the opposite, discharge direction, the leading edges of the notes on the drum bear against the guide from the front, and are separated from the drum by riding over the lifting end of the guide. The guide thus functions as an automatic direction-responsive guide for separating notes from the drum when the drum is rotated in one direction only.

The guide may comprise one or more fingers extending generally tangentially towards the drum. The guide may be pivotably movable between its normal position and the displaced position.

One or more recesses or clearances may be provided in or on the drum to enable the lifting end of the guide to be received below the level of the outermost surface of the drum.

On rotation of the drum in the first direction, if the guide is displaced by notes already stored on the drum, the spring bias action of the guide will press the notes against the surface of the drum to ensure that the notes do not fan out as they leave contact temporarily with the belt means.

A guide as discussed above is referred to herein as passive, as it does not require an electro-mechanical actuator to control its position. This can result in significant space and cost savings for the apparatus, as well as reducing the complexity of the electronic control system.

A sensor switch may be coupled to the guide to provide an indication of whether the guide is in its normal position, which means that any notes on the drum are clear of the guide, and that the drum can be reversed immediately if desired to discharge the notes, or whether the fingers are in a displaced position, which means that at least some of the notes are not clear of the guide, and that the drum is not in a condition in which it can be reversed immediately to discharge the notes. In the latter condition, the drum has to be rotated anticlockwise, for example in small angular steps, until the notes are clear of the guide, allowing the guide to return to the normal position against the drum, before the drum can be reversed to discharge the stack of notes.

As a first example, if the stack is to be discharged from the drum immediately after the last note has been wound on to the drum, a control unit can reverse the direction of rotation of the drum immediately upon the sensor switch indicating that the fingers have returned to the normal position. This can avoid unnecessary rotation of the drum, and can increase the responsiveness of the apparatus (by decreasing the apparent time to discharge the stack). As a second example, if the stack of notes has become misaligned for any reason, such that one or more of the notes is out of register with the proper position of the stack, the sensor switch can be used to identify a suitable rotational position of the drum from which the stack can be discharged. In both of these examples, the basic control operation performed by the control unit can be the same: namely, to continue rotation of the drum in one direction until the switch indicates that the stack is clear of the fingers, and then to reverse the rotation of the drum, for example, through a complete revolution, to discharge the stack.

In a closely related aspect, the invention also relates to a tactile sensor for sensing the presence of notes at a certain position on the drum. One or more movable elements extend towards the drum, and are displaceable from a normal position by contact with notes on the drum, at least when the drum is rotated in one direction. The one or more movable elements are coupled to a sensor switch to provide an output signal indicative of the position of the one or more elements, and hence detect the presence of notes on the drum at that position.

Referring to the discussion above, the elements can be used to detect whether or not the drum is in a condition in which it can be reversed to discharge notes from the drum.

Another aspect of the invention relates to a drive mechanism for rotating the drum. Preferably, a common drive source is used to drive the drum and a transportation system for feeding notes to the drum and for taking notes away from the drum, and the transportation system is operable selectively without rotation of the drum. Such an arrangement can be achieved by using one or more selectable transmission couplings for controlling the operation of the drum. The or each coupling may be coupled directly to the drive source, or it may be coupled to drive the drum from a moving part of the transportation system.

In one embodiment in which the direction of rotation of the drive source is reversed between an operation to feed notes to the drum, and an operation to transport notes away from the drum, only a single selectable transmission coupling is required to drive the drum, since the direction of rotation will be reversed automatically by the drive source when the notes are discharged from the drum.

In an alternative embodiment in which the direction of rotation of the drive source is not reversed between an operation to feed notes to the drum, and an operation to transport notes away from the drum, then two selectable transmission couplings may be required, adapted to provide a respective driving force in the two opposite directions of rotation for the drum. Alternatively, a single selectable transmission coupling may be used in combination with a selectable inverter gearbox mechanism for selectively reversing the direction of the driving force obtained by means of the single coupling.

The or each selectable transmission coupling may comprise a relatively simple clutch mechanism for bringing a belt or roller of transportation system selectively into engagement with a belt or roller for driving the drum. Preferably, the drum is driven through the belt means.

The advantage of using one or more selectable transmission couplings is that, once engaged, the coupling enables synchronism to be maintained between the transportation system and the drum. This is particularly important for timing the movement of the drum so that notes are superimposed neatly in register, one on top of another, on the drum. Such synchronism can be difficult to achieve if independent drive motors are used for the transportation system and for the drum, because there will always be an unpredictable delay in the start-up time of a motor when activated, which will depend on the load the motor has to drive.

A further aspect of the invention relates to controlling the movement of notes in an apparatus which includes a drum escrow or short term storage device. A note received from an input region, for example, an entry slot is transported to sensor means for sensing the note, for example, to determine its authenticity and/or its denomination, and the note is then transported towards an intermediate position from which the note can either be stored on the escrow, or can be rejected or encashed without the need to reject or encash any other notes already stored on the escrow. The note is preferably held at the intermediate position until the output of the sensing means has been processed, whereupon the apparatus can determine how to treat the note. Preferably, the intermediate position is downstream of the sensor means.

In a first particularly preferred embodiment, the apparatus includes separate input and output paths for notes, and the intermediate position is a position of the note in the output path, i.e. the note is forwarded automatically from the input path to the output path, from which the note can be withdrawn for storage on the drum escrow. The output path may thus be regarded as including a region which is in two-way communication with the drum escrow, an inputted note being introduced from the input path to an intermediate position in this region of the output path. Preferably, in order to reduce the space required for the apparatus, the input and output paths are arranged side by side, for example, one on top of the other, and the note is turned through about 180° as it is transported from the end of the input path to the output path.

The intermediate position of the note in the output path may conveniently be a position in which the note is disposed under a note encasher device, such as a note stacker, so that the note can be encashed immediately if desired.

Preferably, the note is routed between the input and output paths, and the drum escrow, by means of passive guides, i.e. guides which do not require electro-mechanical actuators to control their positions.

The above first particularly preferred embodiment is suitable for use with a single selectable transmission coupling, as described hereinbefore, because at relevant times, the direction of movement of the note or notes in the output path is dependent on whether the notes are being transported to, or from, the drum escrow.

In a second particularly preferred embodiment, the intermediate position is a position in which the note is wound partially on to the drum escrow, the tail end of the note remaining free of the drum and separated from any notes already accumulated on the drum. From that position, the drum can either be rotated a little further to store the note fully on the drum, or the drum can be rotated in reverse direction to discharge the note from the drum without discharging any of the notes previously accumulated on the drum. This embodiment has an advantage over the embodiment described above in that it takes very little time to store the note fully on the drum from the intermediate position, this operation being generally the most frequent operation, and this reduces the time that a customer will have to wait before he can insert a following note. However, the mechanism and control unit for putting this embodiment into practice are generally more complex than those required for the previous embodiment.

In order to discharge an accumulated stack from the drum, an electro-mechanically operated guide is preferred, rather than a passive guide, as the electro-mechanically operated guide has the advantage that it can be controlled to move the guide completely clear of the drum during other operations which do not use the guide. If a passive guide were used, when a new note was moved to the intermediate position, the guide would have to remain in contact with the face of the uppermost note of the previously accumulated stack. This could cause a problem because a passive guide is generally suitable for allowing notes to pass under the guide in only one direction of rotation of the drum; in the present embodiment, the drum might be rotated either direction from the intermediate position, the result being that the passive guide would be prone to jamming against the notes on the drum if the drum was rotated in the discharge direction. Such a problem would be dependent on the physical condition of each note, but in practice the apparatus should ideally be able to handle even worn or slightly holed notes without substantial risk of jamming.

Depending on the design of the transportation paths for the notes, this embodiment may be suitable for use with two selectable transmission couplings (or a single selectable transmission coupling with a selectable direction inverter) because, if separate input and output paths are used, the driving source might conveniently operate in only one direction.

In a closely related aspect to the first of these embodiments, the invention also relates to an apparatus wherein a note is transported from an input region to an intermediate position and, in order to move the note from the intermediate position to an escrow, the direction of movement of the note is reversed.

In a closely related aspect to the second of the above embodiments, the invention also relates to controlling the drum escrow to only partially move a note into engagement with the drum so that, if desired, the individual note can be discharged from the drum by reversing the direction if rotation of the drum (through just less than one revolution), without having to discharge any notes which were stored previously on the drum. In general, the tail end of the note will remain clear of the drum, and clear of the notes previously accumulated, and the drum will be halted at the intermediate position until it is desired either to discharge the note, or to advance the note completely on to the drum.

In another general aspect, the invention relates to a temporary storage device. Such a device may be operable to receive sheets fed succesively to the device for storage thereat, and selectively to return the sheets accumulated together in a bundle. Additionally, the device may be operable selectively to return the most recently fed sheet individually without having to return any previously stored sheets accumulated at the storage device. For this purpose, the storage device is operable to store a sheet only partially in an accumulated condition with existing sheets, such that the partially stored sheet can be discharged easily from the remainder of the bundle.

In another aspect, the invention relates to a device for routing sheets between first, second and third transportation paths, and for this purpose a movable guide is used. The guide may be movable between three operating positions.

In yet another aspect, the invention relates to a system for controlling operation of the drum escrow. In this system, a transportation system for feeding notes to (and from) the drum is operable selectively without rotation of the drum. The system includes means for sensing when a note is at a predetermined position in the transportation system, and means for commencing rotation of the drum at a suitable time when the note is advanced towards the drum, so that the note will be received at a predetermined position around the periphery of the drum. In particular, the note can be superimposed in register with any notes already stored around the drum. The drum is controlled to rotate in a forward direction through a complete revolution to store the note, and to return to a predetermined zero position.

In another aspect, an object is to provide an inexpensive and rapidly operating short-term storage for banknotes, which has few moving mechanical parts, which in spite of its large storage capacity is of small dimensions, and which treats the banknotes carefully.

In accordance with this aspect a drive unit for the drum and for the endless belts can be switched over into opposite first and second directions of rotation, the drum being designed for storage of the sheets which are individually fed through the mouth opening by way of a passage by means of a single complete revolution of the drum through 360° in the first direction of rotation so that successively stored sheets form a bundle, and return of the bundle which is stored on the cylindrical surface being effected by way of the same passage through the mouth opening, wherein the drum performs a single complete revolution through 360° in the second direction of rotation.

It will be appreciated that the above aspects may be used independently of each other, or certain of the aspects may be combined to yield further advantageous results.

Further objects, features and advantages of the invention will become apparent from the following description of preferred embodiments of the invention, which is given by way of non-limiting example, with reference to the accompanying drawings in which like parts are designated by like reference numerals.

DETAILED DESCRIPTION OF PREFERRED EMBODIMENTS

Figure 1:
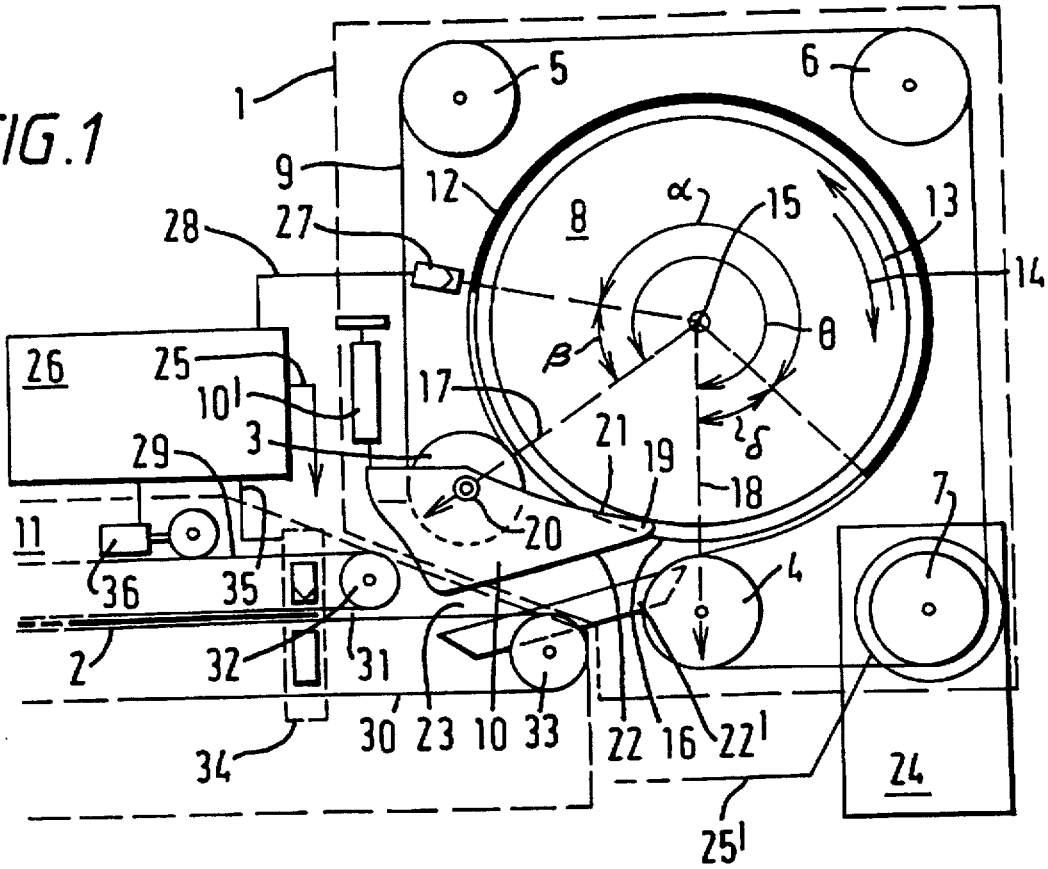
FIG. 1 shows a short-term storage device.

In FIG. 1, reference numeral 1 identifies an intermediate storage device, reference numeral 2 identifies a banknote, reference numerals 3 and 4 identify end rollers, reference numerals 5, 6 and 7 identify guide rollers, reference numeral 8 identifies a cylindrical drum, reference numeral 9 identifies parallel endless belts and reference numeral 10 identifies a switching device. The intermediate storage device 1, together with a transportation system 11 for feeding the banknotes 2 and for guiding them away, forms a device which is referred to hereinafter as a short-term storage device and which collects the successively and individually introduced banknotes 2 in a bundle 12 on the drum 8. The banknotes 2 which are stacked one upon the other in the bundle 12 may be of different dimensions, as are normal in a predetermined set of nominal values. The bundle 12 includes at least one banknote 2.

The drum 8 is rotatably mounted about a drum axis 15 in the two directions of rotation as indicated at 13 and 14, wherein the drum 8 rotates in one direction of rotation 13, for example in the counterclockwise direction, for storage of the banknotes 2, and in the opposite direction of rotation 14, in the clockwise direction, for return of the bundle 12. The size of the drum 8 depends on the dimensions of the largest banknote 2 to be stored. The width of the external cylindrical surface 16 of the drum 8 approximately corresponds to the width of that largest banknote 2, although the banknote 2 can also be wider than the drum 8 and can project beyond it at one or both sides. The diameter of the drum 8 is to be so selected that that largest banknote 2 covers the periphery of the cylindrical surface 16 over an arc embracing an angle α.

A set of parallel endless belts 9 forms loops, which are tensioned by the end rollers 3 and 4 and by the guide rollers 5 through 7, in planes which are parallel to the plane of the drawing in FIG. 1, with the axis of the drum and axes of the rollers 3 through 7, which are parallel thereto, being perpendicular to the above-mentioned planes. The loops of the endless belts 9 are laid around the drum 8 from the outside in such a way that the endless belts 9 are in contact at their outward sides with the periphery of the cylindrical surface 16 over an arc with an angle θ and between the endless belts 9 and the cylindrical surface 16 provide a space for storage of the banknotes 2.

Two dotted-line radii 17 and 18 which are shown as assistance in the drawing in FIG. 1 with their origin on the axis of the drum, pass through the axes of the end rollers 3 and 4 respectively. The radii 17 and 18 divide the periphery of the cylindrical surface 16 into two arcs, of which the larger is associated with the angle θ.

A portion of the cylindrical surface 16, which is not covered by the endless belts 9, remains free between the endless rollers 3 and 4, over an arc with an angle 360°–θ, and forms an opening in the loops of the endless belts 9, through which the banknotes 2 can be unimpededly conveyed into the space for storage and on to the cylindrical surface 16 or outputted in the form of bundles 12 to the transportation system 11. The switching device for guiding the banknote 2 or the bundle 12 respectively on a predetermined transportation path is arranged in that opening between the two endless rollers 3 and 4.

By way of example, the switching device 10 comprises a plurality of parallel finger-like tongues 19 which are jointly rotatable by means of a switching device drive 10' about a pivot axis which is parallel to the axis of the drum. The pivot axis 20 can be identical to the axis of the first end rollers 3, with the tongues 19 being arranged between the first end rollers 3 which are freely rotatable about the pivot axis 20. The switching device drive 10', for example a solenoid, switches the switching device 10 from one position into the other. The fingers 19 face from the pivot axis 20 in the first direction of rotation towards the second end rollers 4 over the sector of the cylindrical surface 16, which is not covered by the endless belts 9. In a return position of the switching device 10, the tongues 19 lie with their ends on the drum 8. In the storage position the ends of the tongues 19 are lifted off the cylindrical surface 16 at least by the thickness of the bundle 12.

Each tongue 19 has a sliding surface 21 and a guide surface 22 which both come together at the end of the tongue 19. The sliding surfaces 21 of the tongues 19 form a surface whose spacing relative to the cylindrical surface 16 in the storage position is such that the bundle 12 of the predetermined maximum thickness on the cylindrical surface 16 is rotatable by passing through beneath the tongues 19. The sliding surfaces 21 extend for example from the first end roller 3 to the points of contact of the tongues 19, just before the second end roller 4. When the ends of the tongues 19 lie against the drum, the guide surfaces 22 form a tangential plane to the cylindrical surface 16. The guide surface 22 and guide bars 22' disposed at a spacing opposite the guide surface 22, define the path for the banknotes 2 or the bundle 12 respectively between the drum 8 and the transportation system 11, as far as a mouth opening 23 of the intermediate storage device 1.

A drive unit 24 is disposed at one of the rollers 3 through 7 and drives the endless belts 9. The drive unit 24 is connected by way of lines 25 and 25' to a control device 26 which is arranged for switching on and off and for controlling the direction of rotation of the drive unit 24. The drive unit 24 can be an electric motor.

The portion of the cylindrical surface 16 with which the endless belts 9 are in contact, being of the arcuate dimension of the angle θ, is divided into three sectors α, β and δ. The first sector β begins at the first radius 17 and the third sector δ ends at the second radius 18. Therebetween the second sector α connects the two outer sectors β and δ.

A sensor 27 for monitoring the angle of rotation of the drum 8 about the drum axis 15 is arranged at the periphery of the drum 8. The sensor 27 is connected by a signal line 28 to the control device 26. It senses the angle of rotation of the drum 8 by optical, mechanical or magnetic means, and it supplies the control device 26 with at least one signal when the drum 8 has performed a full revolution and which establishes the zero point of the angle of rotation of the drum 8.

For example the sensor 27 can be a magnetic sensor which, when the drum 8 rotates, detects the approach of a small permanent magnet which is let into the cylindrical surface 16. The same purpose could be served by a rotary sensor which is connected to the drum 8 or a stepping motor in the drive 24, the stepping motor being controlled by the control device 26.

The sensor 27 is arranged at the boundary between the first arc portion β and the second arc portion α. That location on the cylindrical surface 16 coincides with the leading edge of the stored banknote 2 or the bundle 12 when the drum 8 stops after the storage operation.

The transportation system 11 is part of a banknote reading apparatus which is not described in greater detail herein. The transportation system 11 has a transportation path 31 for the banknotes 2 and for the bundle 12 respectively, which is formed from endless belts 29 and 30. The endless belts 29 and 30 are arranged in pairs in mutually parallel relationship, wherein for example the endless belt 29 above and the endless belt 30 below the transportation path 31 are tensioned by an upper pulley 32 and a lower pulley 33. The transportation path 31 is formed by at least two pairs which comprise the upper endless belt 29 and the lower endless belt 30 and which are in contact with each other along the transportation path 31 and which clamp the transported banknotes 2.

Immediately in front of the mouth opening 23 the transportation system 11 has a sensing device 34 as a sensor for the banknotes 2 at the discharge of the transportation path 31. The sensing device 34 is connected to the control device 26 by way of a signalling line 35, the control device 26 being so designed that, on the basis of signals from the sensing device 34, it can detect the presence of the banknote 2 beneath the sensing device 34 at the mouth opening 23. Light barriers for example are suitable for constituting the sensing device 34, in which case the banknote 2 interrupts a light beam from the sensing device 34 as soon as the leading edge reaches the sensing device 34.

The transportation system 11 is driven by means of a system drive 36 which includes for example an electric motor and which drives the endless belts 29 and 30 by way of one of the pulleys 32', forming a fixed coupling. The system drive 36 is connected to the control device 26.

The control device 26 is designed to control the drive unit 24, the system drive 36 and the switching device drive 10', with the drive means 10', 24 and 36 being connected to the control device 26 by way of lines. Control is effected on the basis of the sensor signals which are passed to the control device 26 from the sensor 27 and the sensing device 34 by way of the signal line 28 and the signalling line 35.

The intermediate storage device 1 is ready for intermediate storage when the drum 8 is at the angle of rotation zero. For example the transportation system 11 can convey the banknote 2 to be freshly stored to the sensing device 34 only after the intermediate storage device 1 is in a state of readiness again to receive same or the banknote 2 can be stopped at the sensing device 34 until the intermediate storage is possible.

At the signal from the sensing device 34, the control device 26 switches on the drive unit 24 which drives the drum 8 in rotation in the first direction 13. The endless belts 9 move at the peripheral speed of the cylindrical surface 16 as they move with same without slipping. At the same time the transportation system 11 pushes the banknote 2 beyond the location of the sensing device 34 and advances it between the guide surfaces 22 and the guide bars 22' to the cylindrical surface 16.

Figure 2:
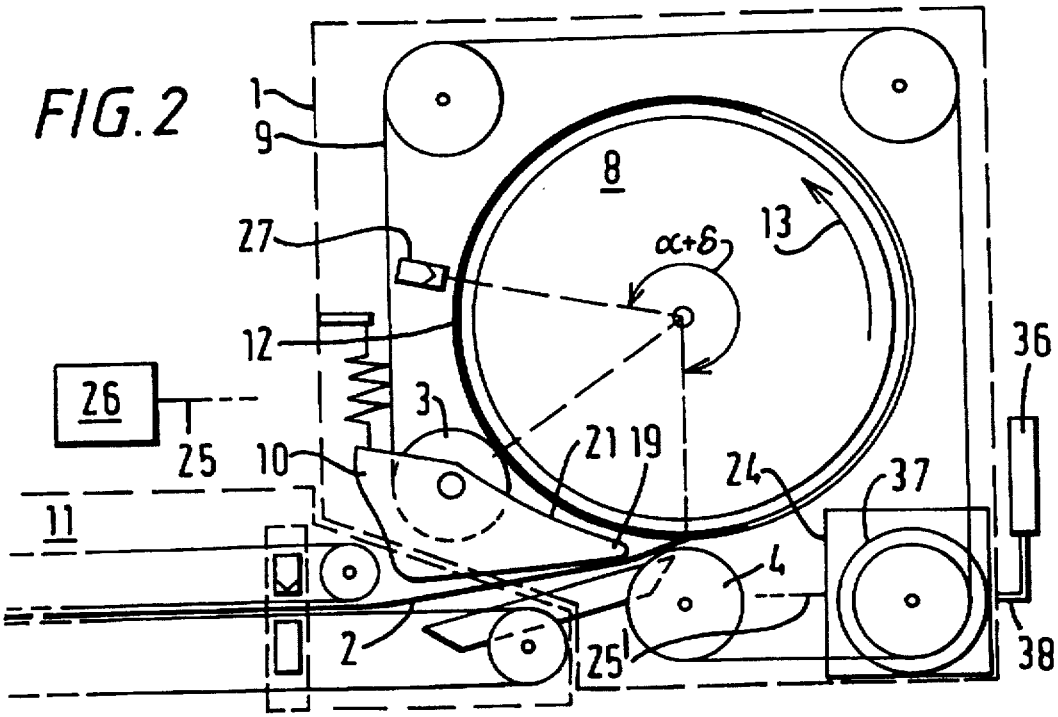
FIG. 2 shows the short-term storage device when receiving a banknote.

In FIG. 2 the mutually aligned leading edges of the banknote 2 and the bundle 12 have been simultaneously engaged by the endless belts 9 under the second end roller 4, with the moment at which the drive unit 24 is switched on, the speed of rotation of the drum 8 and the predetermined angle β (FIG. 1) being matched to the forward feed speed of the banknote 2 in the transportation system by the control device 26 (FIG. 1). The switching device 10 is in the storage position, with the ends of the tongues 19 being lifted off the cylindrical surface 16 (FIG. 1) only to such a degree that both the bundle 12 and also the banknote 2 can unimpededly pass simultaneously to the second end roller 4 and are there engaged by the endless belts 9 and pressed against the cylindrical surface 16. The sliding surfaces 21 prevent the bundle 12 from fanning out when it comes out from under the first end roller 3.

Then the bundle 12 which has been increased in size by the further banknote 2 rotates together with the drum 8 about the drum axis 15 until the angle α+δ has been covered and the sensor 27 again detects the angle of rotation zero of the drum 8. The control device 26 switches off the drive unit 24. The drum 8 has thus performed a complete revolution of 360° for storing the banknote 2. The intermediate storage device 1 is now ready again for a further operation, with the drum 8 and the bundle 12 being in the rest position shown in FIG. 1.

The drive unit 24 in FIG. 2 advantageously has a selectable transmission coupling 37 which can be actuated by the control device 26 by way of the line 25, 25' and which is connected to the system drive 36 by way of a mechanical transmission 38. In response to a signal from the control device 26 the coupling 37 transmits a torque produced by the system drive 36 to the drum 8 and the endless belts 9, the torque being supplied to the coupling 37 from the system drive 36 by way of the transmission 38. Control of the intermediate storage device 1 and synchronisation with the transportation system 11 can be effected more easily by means of that drive unit 24 because the direction of rotation 13 or 14 (FIG. 1) of the drum 8 is always predetermined by the transportation direction of the banknote 2 or the bundle 12 respectively in the transportation system 11.

Figure 3:
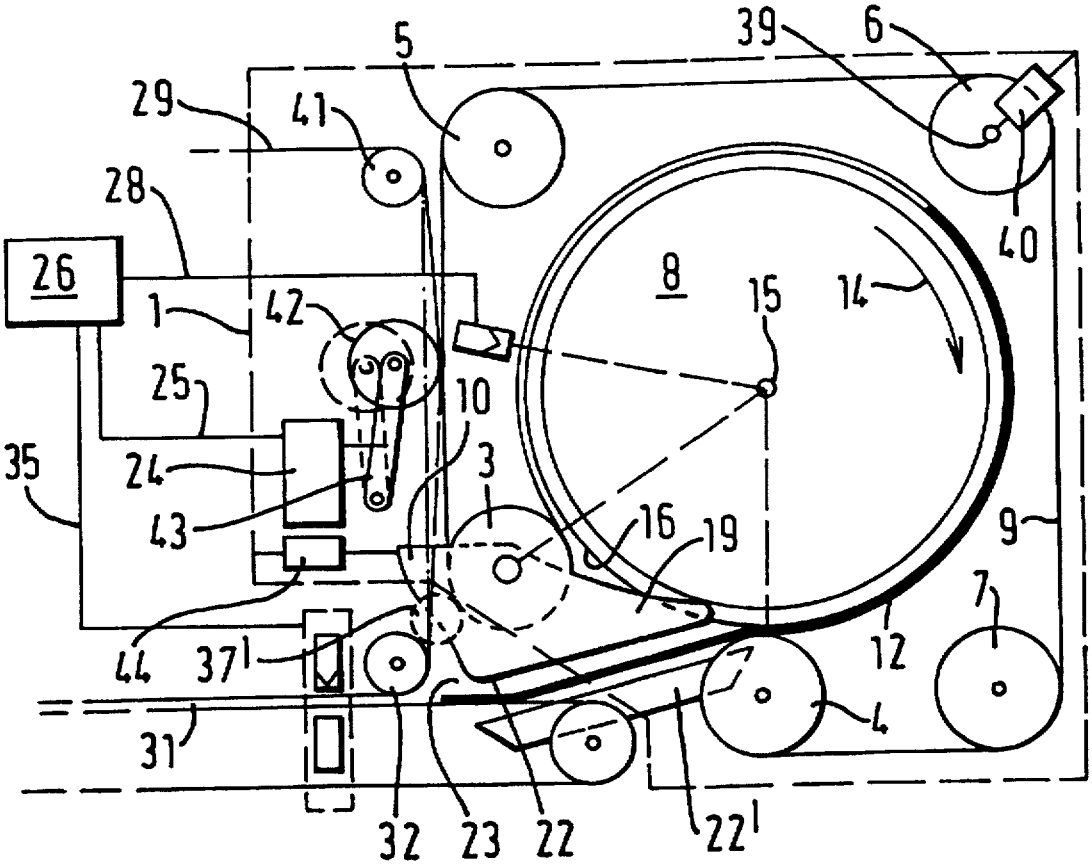
FIG. 3 shows the short-term storage device when returning the stored banknotes.

In FIG. 3, preferably at least one of the guide rollers 5 through 7 is mounted on a displaceable shaft 39 which is displaced under the force of a spring 40 to such an extent that the endless belts 9 are always taut around the drum 8 and the rollers 3 through 7, irrespective of the thickness of the bundle 12. The admissible thickness of the bundle 12 can therefore be several millimeters so that the intermediate storage device 1 has a sufficiently large capacity for storing many banknotes 2 (FIG. 1).

When an input operation for the banknote reader is concluded, at least one banknote 2 is disposed in the intermediate storage device 1. The intermediate storage device 1 is caused by the control device 26 to return the bundle 12 if the drum 8 is in the position with the angle of rotation zero. By means of the drive unit 24, the control device 26 drives the drum 8 in rotation in the direction 14, the clockwise direction, around the drum axis, until the drum 8 has performed a full revolution of 360'. During that period the switching device is in the return position. The bundle 12 is lifted off the cylindrical surface 16 by means of the tongues 19 and pushed through between the guide surfaces 22 and the guide bars 22' and out of the mouth opening 23, there taken over by the transportation system 11 (FIG. 1) and conveyed along the transportation path 31 to a destination for the bundle 12.

The advantage of the short-term storage device lies in the simple, self-contained and compact structure of the intermediate storage device which, while being of small external dimensions, has a high storage capacity, and which provides both for the feed of banknotes 2 and also the return of banknotes 2 by way of a single passage which, defined by the guide surfaces 22 and the guide bars 22' extends from the drum 8 to the mouth opening 23. The short-term storage device is quick in operation and treats the banknotes 2 carefully as, in the operation of storing a banknote 2 or when returning the bundle, the drum 8 only performs a complete revolution in a respective predetermined direction 13 (FIG. 1) or 14 respectively and the banknotes 2 are fed to and removed from the short-term storage device practically tangentially.

The self-contained structure of the intermediate storage device 1 advantageously permits simple replacement or subsequent installation as an addition to the transportation system 11 if a short-term storage device is required. If the control device 26 is already so designed for controlling the intermediate storage device 1, it is sufficient to make the connections 25, 28 and 35, for those control functions to be performed.

The angle θ (FIG. 1) can lie in the range of from 270° to 330°. By way of example, the angle θ is about 300°, and the angle β (FIG. 1) and the angle δ (FIG. 1) are each 30°, so that 240° remain for the angle α (FIG. 1). If the predetermined set of nominal values, as the largest banknote 2, contains a banknote which is 20 cm in length, the drum 8 must be of a diameter of at least 95 mm. It is to be noted here that, in terms of selecting the diameter, the designer preferably looks for the longest banknote 2 out of a large number of currencies in order to be able to cover a wide market range with a single diameter in respect of the drum 8, and to adapt the magnitudes of the angles α and δ by displacement of the sensor 27.

An inexpensive configuration for the selectable transmission coupling 37 (FIG. 2) and the transmission 38 (FIG. 2) can be provided by means of a frictional connection between at least one endless belt 9 and one of the upper endless belts 29 as the endless belt 9 on the first end roller 3 and the upper endless belt 29 on the upper belt pulley 32 always move in the same direction in both directions of rotation 13 and 14 of the drum 8. Therefore the torque can be transmitted in a particularly simple fashion from the transportation system 11 (FIG. 2) to the intermediate storage device 1, for example by means of coupling drum 37' which is shown here in broken line and which, during a complete revolution of the drum 8, is pressed against the first end roller 3 and the upper pulley 32 by suitable electromagnetic means (not shown here) of the drive unit 24 for transmission of the torque.

In another embodiment of the selectable transmission coupling the upper endless belt 29 is guided on a section between the upper belt pulley 32 and a direction-changing roller 41 at a small spacing from and parallel to a section of the endless belt 9 between the first end roller 3 and the guide roller 5, as is shown in FIG. 3 by a dash-dotted line. A pressure roller 42 of the drive unit 24 is mounted for example on an arm 43 which is mounted rotatably about an axis which is parallel to the drum axis 15. In the position shown in dotted line the pressure roller 42 is lifted off the endless belt 29 while in the position shown in solid line the pressure roller 42 rolls against the inward side of the endless belt 29. In that situation the endless belt 29 is pressed against the endless belt 9 so that a frictional connection is made. The drive unit 24 pivots the arm 43 into one of the two positions in response to a command from the control device 26.

In equivalent fashion the endless belt 9 can also be pressed against the upper endless belt 29 in order to produce the frictional connection.

The drive unit 10' (FIG. 1) is advantageously a spring element 44 which is supported against a housing wall of the intermediate storage device 1 and which urges the tongues 19 against the drum 8. That simplifies the requirements imposed on the control device 26. The sliding surfaces 21 are of such a configuration that, in the storage operation, the tongues 19 are lifted by the bundle 12 off the cylindrical surface 16 to such an extent that it can be advanced towards the second end roller 4. After the drum 8 with the bundle 12 has rotated past the tongues 19, the tongues 19 bear against the drum 8 again, as is required for the return of the bundle 12.

Figure 4:
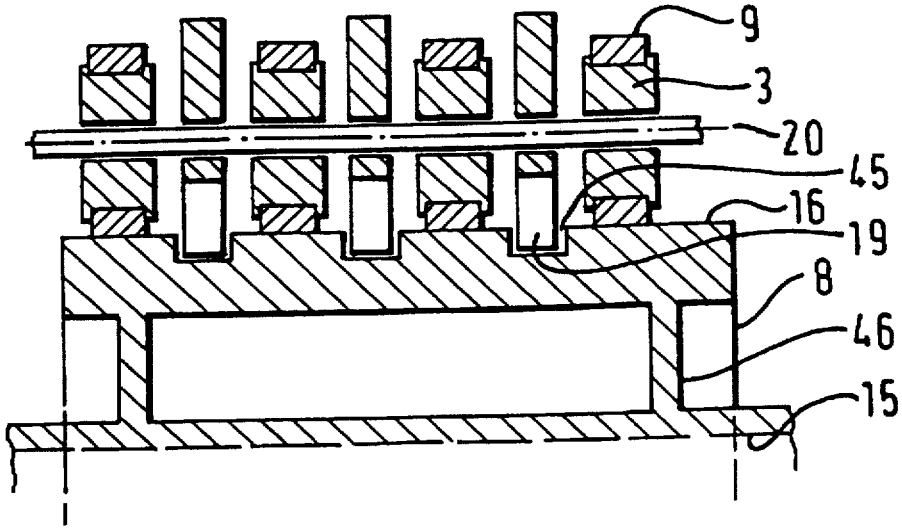
FIG. 4 is a view in cross-section through a drum of an intermediate storage device.

FIG. 4 shows a view in section through the drum axis 15 and the pivot axis 20 in the first direction of rotation 13 (FIG. 1) By way of example, four parallel endless belts 9 bear against the cylindrical surface 16 and are guided around the end rollers 3. The end rollers 3 are freely rotatably arranged on the pivot axis and enclose the tongues 19. The drum 8 advantageously has groove-like depressions 45 in the cylindrical surface 16 so that in the return phase the bundle 12 (see FIG. 3) is not facing the ends of the tongues 19 and the banknotes 2 (FIG. 3) are not damaged.

The speed of the intermediate storage device 1 can be increased, with the same torque, if the rotating mass of the drum 8 is reduced. The drum 8 may be for example a hollow cylinder as shown in FIG. 4, which is supported on the drum axis by spokes 46. The drum could also be formed by a number of wheels mounted on an axle. The wheels may be placed in contact with each other and, in such a case, wheels may have appropriate different diameters to define the same form of recessed outer profile as shown in FIG. 4. Alternatively, the wheels may be spaced apart to define clearances between the wheels. The tongues 19 may then be received in the clearances when the tongues are in the position to return the notes from the drum.

It is possible for the bundle 12 to be stacked on the drum 8 in FIG. 1, with the trailing edges of the banknotes 2 being aligned with respect to each other, instead of the above-described process for aligning the leading edges of the banknotes 2 in the bundle 12.

The length of the banknote 2 arriving at the mouth opening 23 is known from the identification operation. The sensor 27 and the sensing device 34 must detect the trailing edges of the banknotes so that they trigger off the predetermined function in the control device 26. For that manner of forming the bundle, the position of the sensor 27 is displaced through the angle $\alpha$ in the second direction of rotation 14 and the sensing device 34 is to be arranged in front of the mouth opening 23 at least by the maximum length of the permitted banknotes 2.

Instead of banknotes, other, singly supplied items in sheet form of paper, foil or the like can also be bundled and outputted again in a predetermined number to the transportation system 11.

FIGS. 8–12 illustrate an integrated system including an escrow, for validating, accumulating, rejecting and encashing banknotes. The system is self-contained within a case 100 which sits on top of a separable storage vault (not shown) for storing banknotes encashed by the system.

Figure 8:
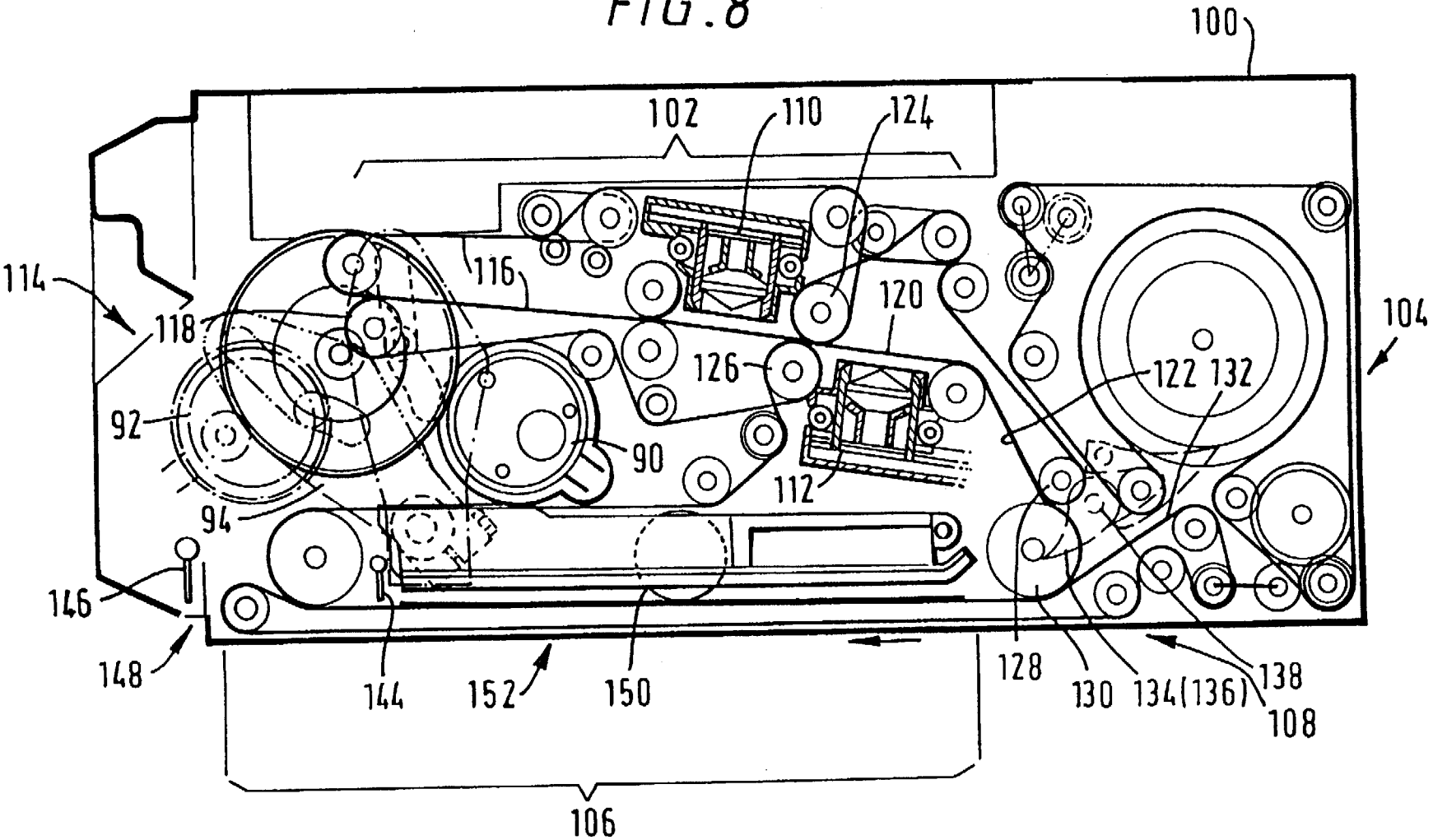
FIG. 8 is a schematic sectional view through an apparatus including an escrow.
Figure 9:
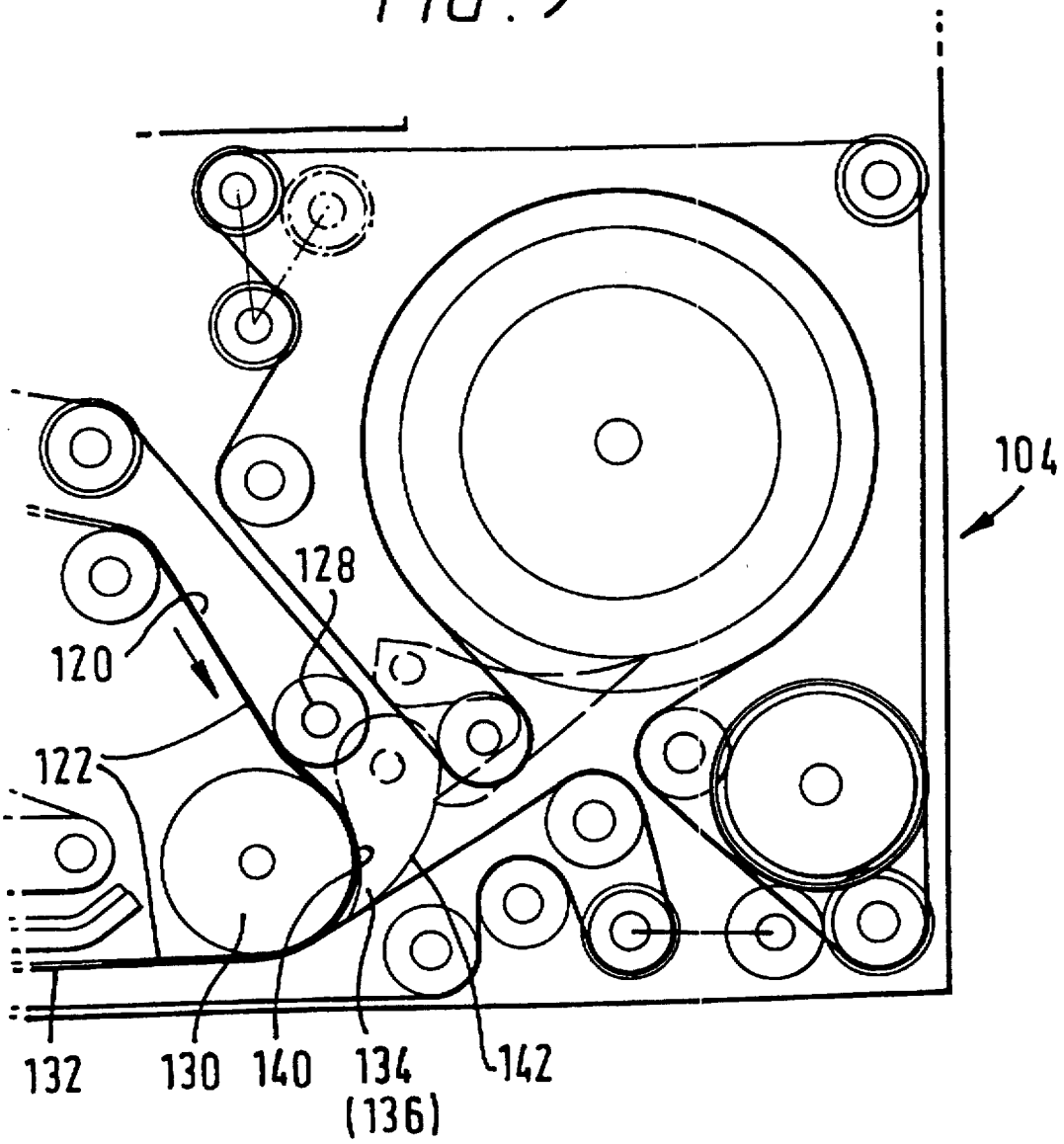
FIGS. 9–12 are partial sectional views illustrating the routing of a note in the apparatus of FIG. 8, and the operation of the escrow.

Referring to FIG. 8, the system consists of an input section 102 which accepts individual notes introduced by a customer and senses each note to determine whether the note is authentic and, if so, its denomination. The system also includes an escrow 104 for accumulating valid notes introduced by the customer, and an output section 106 for returning notes to a customer as necessary, and for encashing notes on completion of a transaction. The input and output sections 102 and 106, and the escrow 104 are coupled by a routing section 108 for controlling the routing of the notes between the various parts of the system. A control unit (not shown) controls the operation of the input section 102, the output section 106 and the escrow 104.

The input section 102 includes a first optical sensor 110 for sensing an upper face of an introduced banknote, and a second optical sensor 112 downstream of the first sensor 110, for sensing the lower face of the note. In the drawings, the thickness of the note is exaggerated for the sake of clarity. The note is inserted through an entry slot 114 and is transported past the first sensor 110 by means of first and second (upper and lower) sets of moving endless belts, 116 and 118 respectively. The note is similarly transported past the second sensor 112 and towards the routing section 108 by third and fourth (upper and lower) sets of endless belts, 120 and 122 respectively.

The first and third sets of (upper) belts 116 and 120 are guided around respective sets of pulleys which include a common upper pulley roller 124. Similarly, the second and fourth sets of (lower) belts 118 and 122 are guided around respective sets of pulleys which include a common lower pulley roller 126. The spacing of the belts 116 in the first set, and the spacing of the belts 122 in the fourth set are each such that the belts do not substantially obstruct the faces of the note from being sensed by the two optical sensors 110 and 112. The third set of belts 120 is offset relative to the first set of belts 116 such that the two sets of belts do not interfere with each other as they pass around the pulley roller 124. Similarly, the fourth set of belts 122 is offset relative to the second set of belts 118.

After passing the second optical sensor 112, the third and fourth sets of belts 120 and 122 carry the note to the routing section 108 at which the belts 120 and 122 separate. The third set of belts 120 are returned around a return pulley 128 which consists of a group of spaced apart pulley wheels mounted on a common axle, one pulley wheel for each belt 120 in the third set. The fourth set of belts 122 continues around a guide pulley 130 which also consists of a number of spaced apart pulley wheels mounted on a common axle, one pulley wheel for each belt 122 of the fourth set. At the guide pulley 130, the fourth set of belts 122 meet a fifth set of belts 132 to form upper and lower belts for transporting notes in the output section 106.

The routing section 108 includes a first movable guide 134 for guiding notes to and from the output section 106. The first movable guide 134 consists of a number of guide fingers 136 which are pivoted on an axle 138 and are received in the spaces between the pulley wheels of the return pulley 128 and the guide pulley 130. Each finger 136 has a generally curved, wedge shape and includes an abutment edge 140 and a guide edge 142. The fingers 136 are biased by a spring (not shown) to a normal position (FIG. 8) in which the fingers 136 extend across the path of a note being transported by the third and fourth sets of belts 120 and 122, respectively. When the note is advanced into engagement with the fingers 136 by the movement of the belts 120 and 122, the leading edge of the note bears against the abutment edge 140 of each finger 136, causing the fingers 136 to be displaced to allow the note to pass (see FIG. 9). The curved shape of the abutment edge 140 guides the note around the guide pulley 130, such that the note is received between the fourth and fifth sets of belts 122 and 132, respectively, and is advanced into the output section 106. Once the trailing end of the note has moved past the fingers 136 of the movable guide 134, the fingers 136 are returned to their normal position under the action of the bias spring.

The note is advanced in the output section 106 until it reaches an intermediate position (see FIG. 8) at which the leading edge of the note bears against a movable sensor finger 144. The sensor finger 144 operates a switch (not shown) to send a signal to the control unit to cause the control unit to stop the belts 122 and 132.

If the control unit has not yet finished processing the outputs from the two optical sensors 110 and 112 to determine whether the note is authentic and to determine its denomination, then the note is held temporarily at the intermediate position in the output section 106 until the processing is completed.

If the note is found to be unacceptable, then the control unit drives the fourth and fifth sets of belts 122 and 132 to advance the note further to the left, past a one-way flap 146 and through an exit slot 148 to return the note to the customer. A sensor switch (not shown) is coupled to the one-way flap 146 to determine when the flap re-closes once the note has been fully ejected, so that the apparatus can be made ready to accept a further note through the entry slot 114. It will be appreciated that the unacceptable note can be thus ejected without interfering with notes which may already have been stored by the escrow 104, and in particular without having to eject the entire stack of (valid) notes on the escrow 104 which the customer may already have entered into the system.

If the note is found to be acceptable, and the transaction completed by the customer involves only that single note, then the note can be encashed immediately by the output section 106. A note stacker piston or plunger (shown schematically at 150) positioned above the note at the intermediate position in the output section 106, can be driven to bear downwardly on the note to push the note out of the grip of the fourth and fifth sets of belts 122 and 132, and downwardly through an encash opening 152 into the vault (not shown) positioned below the case 100. It will be appreciated that this can be done without requiring the single note to be stored by, and retrieved from, the escrow 104.

Figure 10:
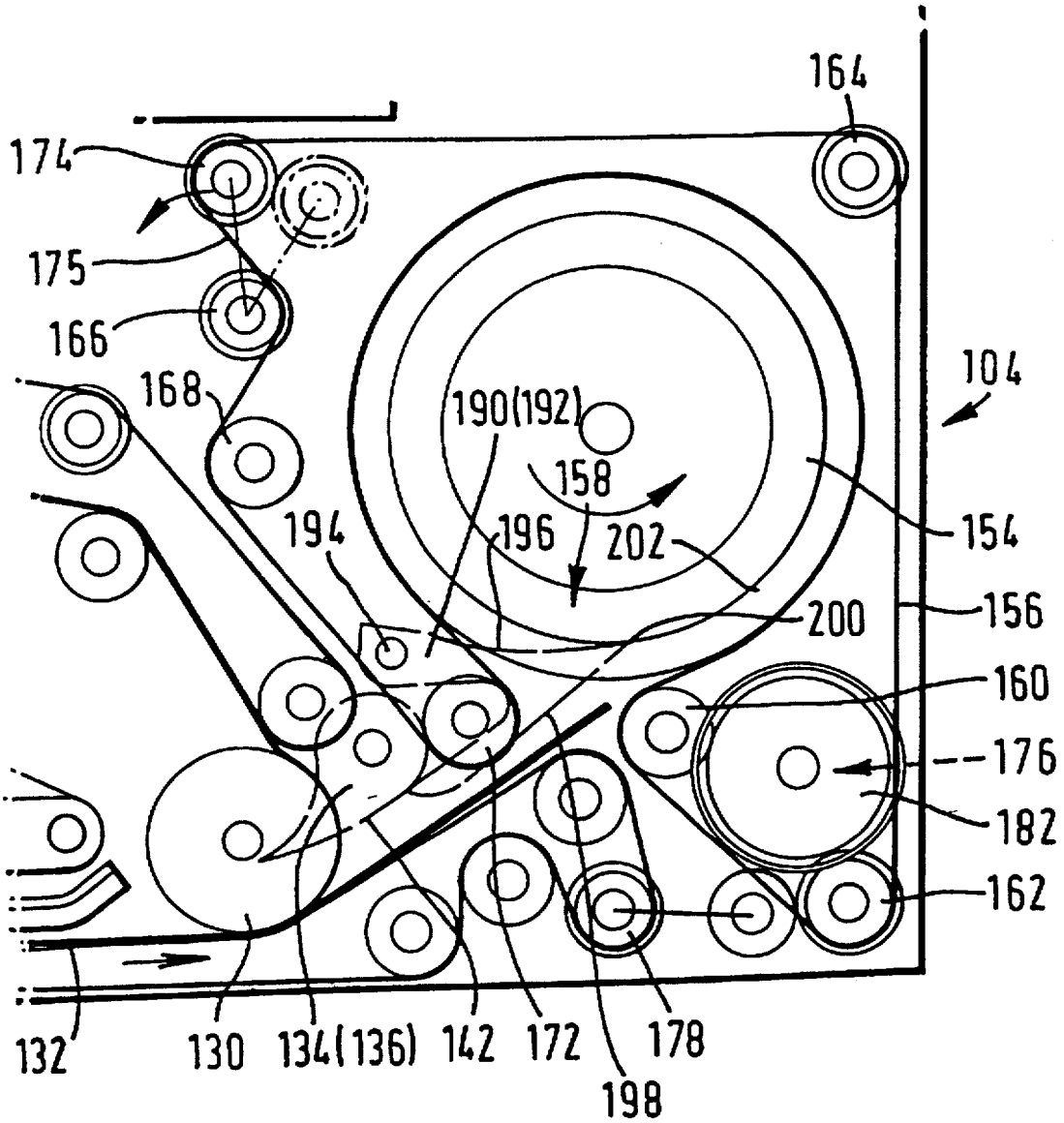

Alternatively, if the note is found to be acceptable, and the transaction desired by the customer may involve further notes, then the control unit drives the fourth and fifth sets of belts, 122 and 132 respectively, to "reverse" the note out of the output section 106 back to the routing section 108. Referring to FIG. 10, as the note is transported past the guide pulley 130, the guide edges 142 of the fingers 136 of the guide 134 guide the note automatically under the fingers 136 and towards the escrow 104.

The escrow 104 is of a similar construction to the storage device described with reference to FIGS. 1 to 4, and comprises a drum 154 around which notes are stored. A set of parallel, endless escrow belts 156 extends around a major portion of the circumference of the drum leaving clear an entry/exit region 158. The escrow belts 156 are guided on a return path spaced from the drum 156 by sets of pulleys 160,162,164,166,168,172 and 174, the pulleys 160–172 being fixed, and the pulleys 174 being mounted on a movable arm 175 biased in the direction denoted by the arrow by a spring (not shown) to tension the belts 156 and to allow for expansion of the overall size of the drum as the number of stored notes increases.

The escrow belts 156 are driven by means of an electrically activated clutch (shown schematically at 176) which transmits driving force from the fifth set of belts 132. A two-way electro-mechanical actuator may be used to operate the clutch 176, or the clutch may be biased in one direction (e.g. towards the disengaged position) by a spring, and an actuator used to move the clutch in the other direction (e.g. to the engaged position). A modified clutch could also be used, based on a similar principle, in which either the fifth set of belts 132 or the pulley roller 178 could be used against the escrow belts 156, without requiring the use of an intermediate drive wheel 182.

As part of both the routing section 108 and the escrow 104, a second movable guide or switch 190 guides notes being introduced to, or disengaged from, the drum 154. The switch 190 consists of a number of spaced fingers 192 having a generally V-shape and pivoted on axle 194. Each finger has an upper guide edge 196 and a lower guide edge 198 which meet at the tip 200, and each finger is biased towards a normal position (shown in FIG. 10) in which the tip 200 bears against the drum 154 and is received in a respective annular recess 202 in the surface of the drum. The clearance in the V-shape enables the fingers 192 to be movable away from the surface of the drum 154 (as explained below) without interfering with the axle on which the pulley 172 is mounted.

Referring to FIG. 10, when a note is moved from the output section 108 to the escrow 104, the clutch 176 is engaged to commence rotation of the drum 156. Movement of the fifth set of belts 132 in this direction causes anticlockwise rotation of the drum 154. As mentioned above, the note passes under the guide edges 142 of the first guide 134, and is guided by the lower guide edges 198 of the fingers 192 and by the fifth set of belts 132 and the escrow belts 156 on to the surface of the rotating drum 154, where it is received between the drum 154 and the escrow belts 156. The drum 154 is stopped when the note is stored away from the entry/exit region 158, as discussed above for the embodiment in FIGS. 1–4.

Figure 11:
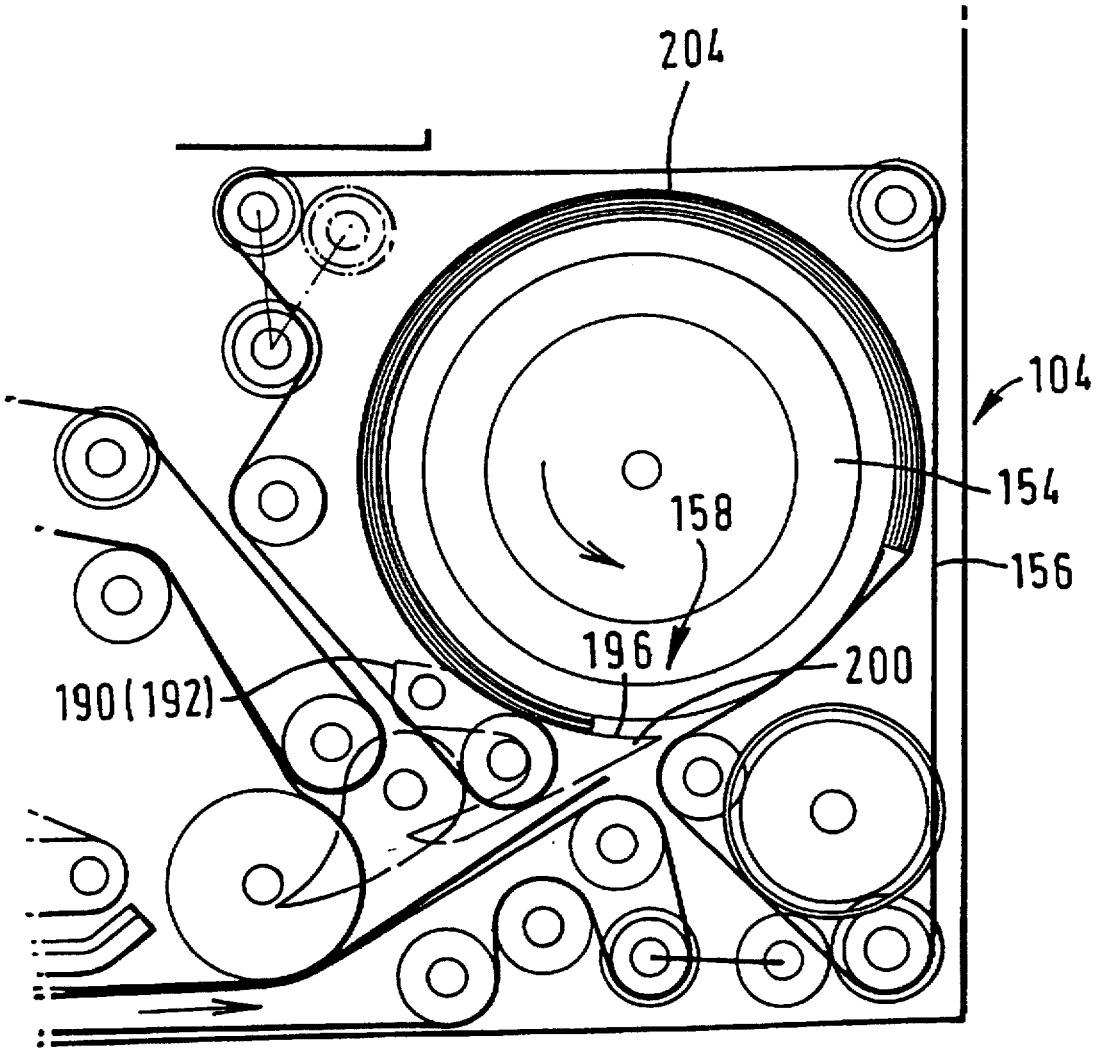

Each note entered subsequently by the customer is processed as described above and, if valid, is transported to the escrow 104 to be stacked with the note or notes already present on the drum 154. Referring to FIG. 11, rotation of the drum is started at an appropriate time such that the leading edge of the note approaching the drum 154 will be aligned with the leading edge of each note on the drum, to form a neat stack. As the drum 154 begins to rotate, the leading edge of the stack 204 of one or more notes previously stored on the drum 154 bears against the guide edges 196 of the fingers 192, causing the fingers 192 to be displaced outwardly to permit the stack 204 to pass under the tip 200, to meet the approaching note in the entry/exit region 158. The switch 190 and fingers 192 thus constitute a tactile means displaceable by contact with the sheets. The guide edges 196 pressing against the surface of the stack 204 ensure that the notes of the stack 204 do not fan out as the stack 204 temporarily leaves contact with the escrow belts 156 while in the entry/exit region 158. The fingers 192 return to the normal position under the spring bias once the stack 204 has moved past the tips 200 of the fingers 192.

Figure 12:
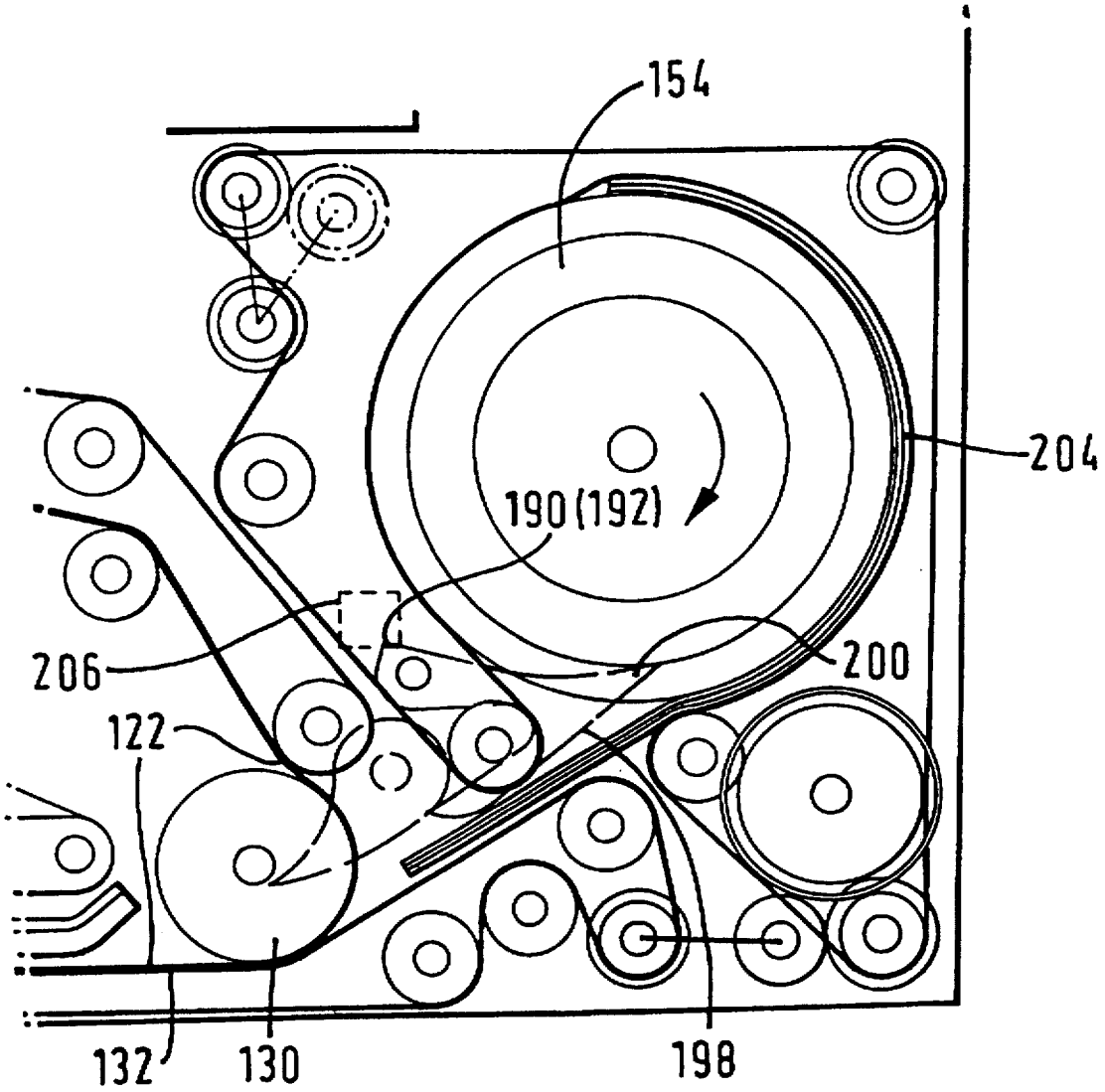

As in the embodiment described with reference to FIGS. 1 to 4, in order to discharge the stack 204 from the drum 154, the direction of rotation of the drum is reversed. This is achieved by changing the direction of movement of the fifth set of belts 132. Referring to FIG. 12, as the stack of notes (moving in the clockwise direction) engages the fingers 192, the leading edge of the stack is lifted off the drum 154 by riding over the tips 200 of the fingers 192 and along the lower guide surfaces 198 of the fingers 192. Continued rotation of the drum 154 moves the stack further towards the guide pulley 130 until the stack is received between the fourth and fifth sets of belts, 122 and 132 respectively, which transport the stack 204 into the output section 106. The stack 204 can then either be returned to the customer through the exit slot 148 (for example, if the customer has requested return of the notes or the transaction has been cancelled), or the stack 204 can be encashed by the plunger 150 (if the transaction has been completed).

A sensor switch (shown schematically at 206) is operated by the fingers 192 of the switch 190, and provides an indication of whether the fingers 192 are in the normal position, which means that any notes on the drum 154 are clear of the entry/exit area 158 and that the drum can be reversed immediately if desired to discharge the notes, or whether the fingers 192 are in a displaced position, which means that at least some of the notes are not clear of the entry/exit area 158, and that the drum 154 is not in a condition in which it can be reversed immediately to discharge the notes. In the latter condition, the drum 154 has to be rotated anticlockwise, for example in small angular steps, until the notes are clear of the fingers 192, allowing the fingers 192 to return to the normal position against the drum 154, before the drum 154 can be reversed to discharge the stack 204 of notes.

As a first example, if the stack 204 is to be discharged from the drum immediately after the last note has been wound on to the drum 154, the control unit can reverse the direction of rotation of the drum 154 immediately upon the switch 206 indicating that the fingers 192 have returned to the normal position. This can avoid unnecessary rotation of the drum, and can increase the responsiveness of the apparatus (by decreasing the apparent time to discharge the stack). As a second example, if the stack 204 of notes has become misaligned for any reason, such that one or more of the notes is out of register with the proper position of the stack, the switch 206 can be used to find a suitable rotational position of the drum 154 from which the stack 204 can be discharged. In both of these examples, the basic control operation performed by the control unit can be the same: namely, to continue rotation of the drum 154 in the anticlockwise direction until the switch 206 indicates that the stack 204 is clear of the fingers 192, and then to reverse the rotation of the drum 154, for example, through a complete revolution.

In addition to the switch 206, further sensors (not shown) similar to the sensors 27 and 34 described with reference to FIGS. 1–4, can be provided for sensing the rotational position of the drum 154, and for sensing the presence of a note approaching the drum for controlling operation of the clutch 176.

Figure 5:
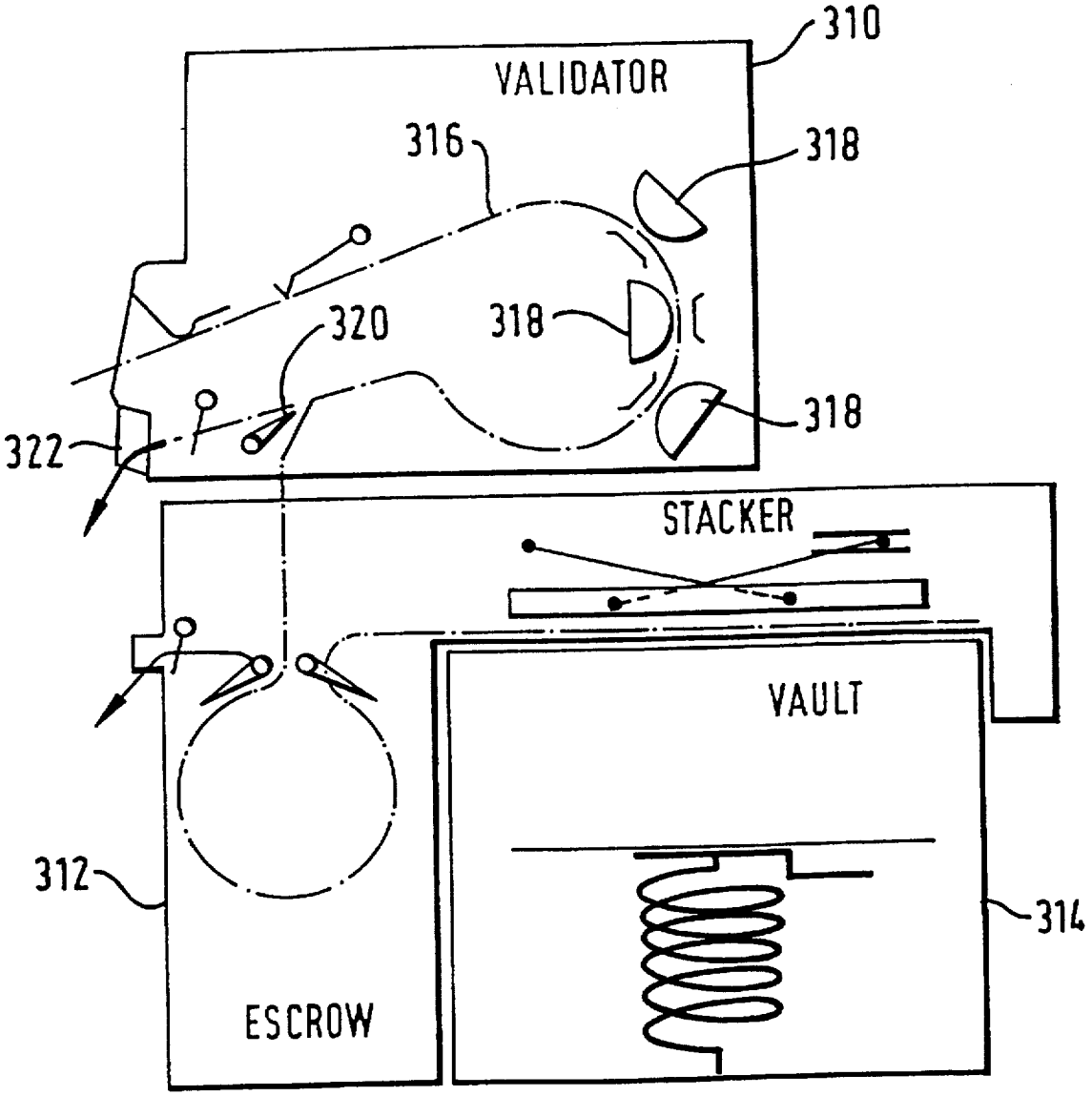
FIG. 5 (PRIOR ART)
FIGS. 5–7 illustrate a known prior art apparatus (described hereinbefore)
Figure 6:
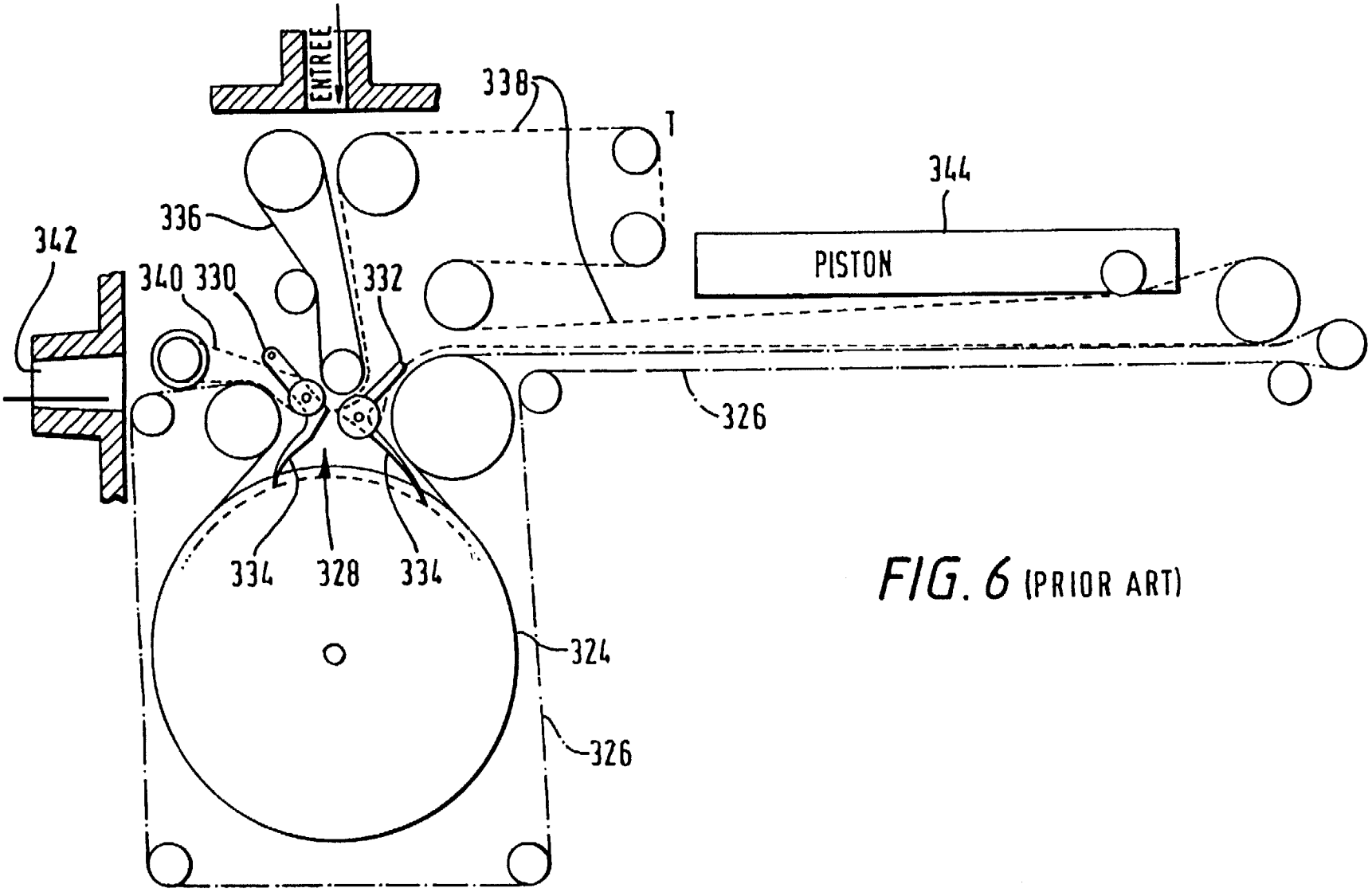
FIG. 6 (PRIOR ART)
Figure 7:
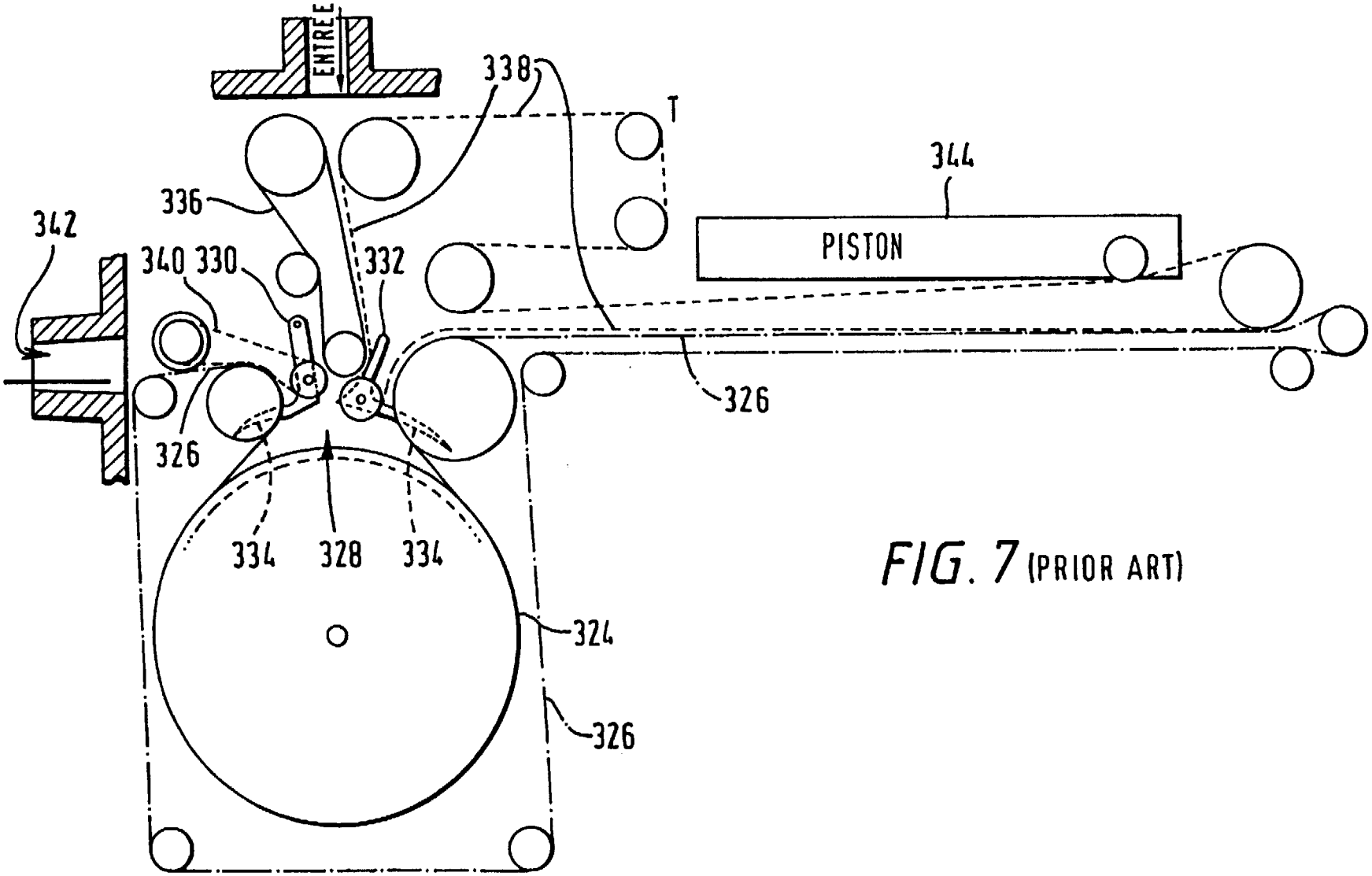
FIG. 7 (PRIOR ART)

The design described above enables an apparatus to be provided for processing banknotes which is substantially more compact than the previous known equivalent apparatus (discussed with reference to FIGS. 5–7), and which is also considerably less expensive. Significantly, the two movable guides 134 and 190 are both passive devices, i.e. they do not rely on dedicated electro-mechanical actuators to control the routing of notes, and this results in considerable space saving in the apparatus, and removes the need for dedicated electronic circuitry to control the operation of the guides 134 and 190.

Furthermore, only a single drive unit (for example, an electric motor) need be provided to drive all of the belts, and the drum 154. The belts 116, 118, 120, 122, 132 are mutually arranged such that the belts all move together, and the drum 154 and the escrow belts 156 are driven selectively from the fifth set of belts 132 by means of the relatively simple clutch 176. It will be appreciated that the use of such a simple clutch arrangement is possible because the direction of movement of the fifth set of belts 132 is always in accord with the appropriate direction of rotation of the drum, i.e. the fifth set of belts 132 move in one direction when notes are being transported to the escrow 104, and in an opposite direction when the notes are to be discharged from the escrow 104. It will also be appreciated that, in fact, the escrow belts 156 could be driven by a clutch coupled to any of the first, second, third, fourth and fifth sets of belts in this design, because these belts all move in unison.

Referring to FIG. 8, a drive motor for the belts is shown at 90, and a second drive motor for operating the plunger 150 is shown at 92. The second driver motor operates a fork 94 which in turn extends a pantograph (not shown) to move the plunger downwardly.

A modified embodiment of the above apparatus is described with reference to FIGS. 13–17. In the modified embodiment, the input section 102 and the output section 106 are unchanged (and so are not shown in detail in FIG. 13), but the designs of the escrow **104*a* and routing section 108*a* are modified. The principle of operation of the apparatus in FIG. 13 is similar to that of FIG. 8 in that an inserted banknote is transported to an intermediate position, but instead of note being transported to an intermediate position in the output section 106, the note is wound partially on the escrow drum 154** as the intermediate position.

Figure 13:
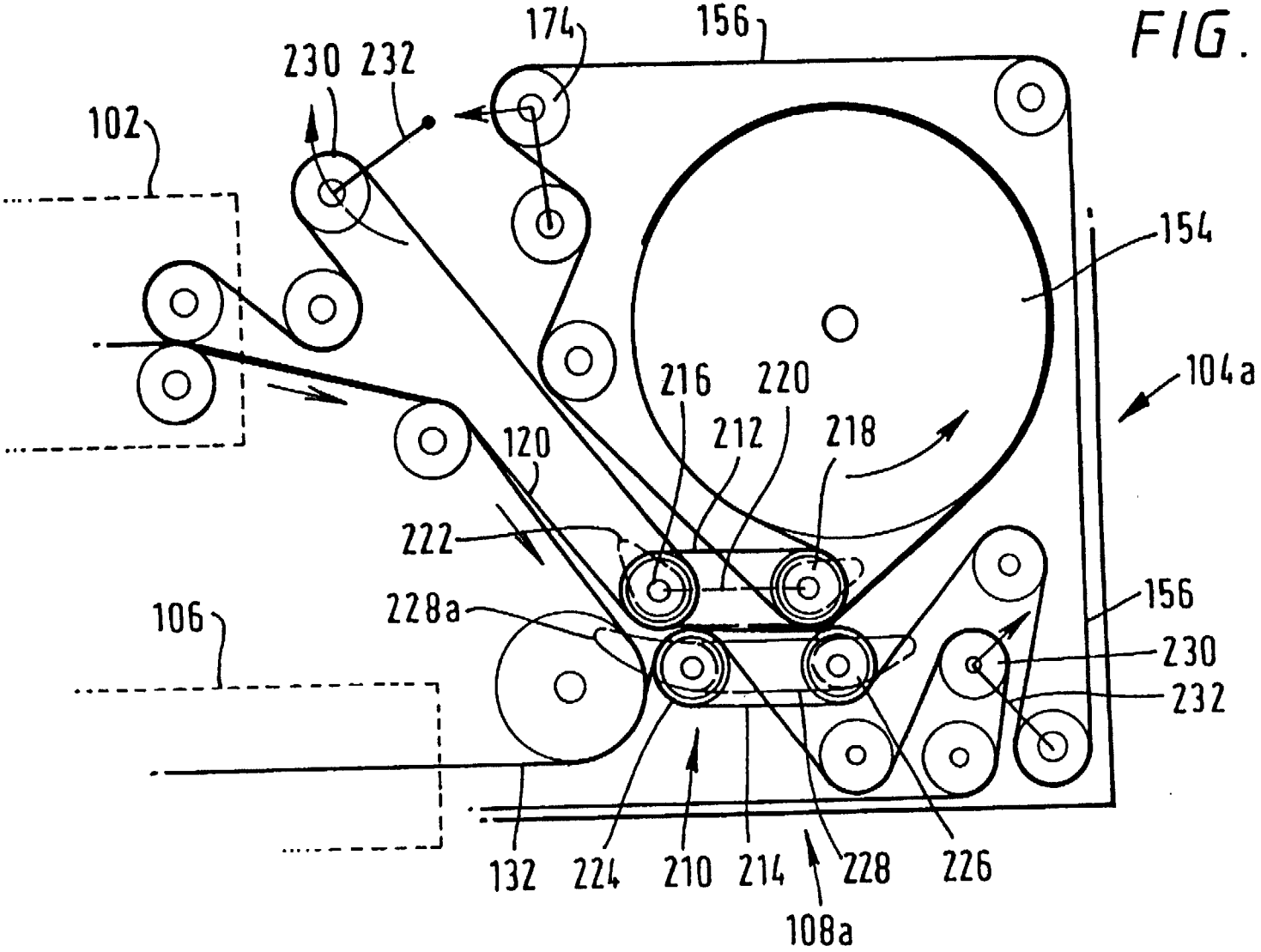
FIG. 13 is a schematic sectional view through a second modified embodiment including an escrow.
Figure 14:
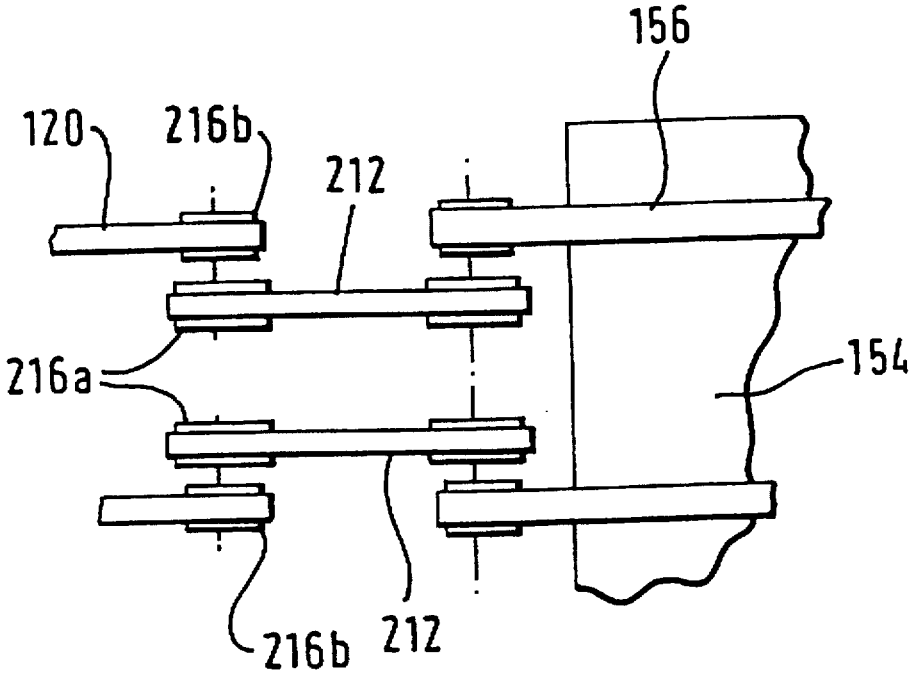
FIG. 14 is a plan view of the switching device of the embodiment shown in FIG. 13, FIGS. 15–18 are partial sectional views illustrating the routing of a note in the apparatus of FIG. 13, and the operation of the escrow.

Referring to FIGS. 13 and 14, the two passive movable guides 134 and 190 of the previous embodiment are replaced by a switching device 210 which comprises sixth and seventh relatively short sets of (upper and lower) endless belts, 212 and 214 respectively, which articulate with the third and fifth sets of belts, 120 and 132, and with the escrow belts 156 to define a continuous belt transportation path to and from the drum 154. The sixth set of belts 212 extend around upper pulley rollers 216 and 218, around which the third set of belts 120 and the escrow belts 156 also extend, respectively. The puller roller 218 is mounted on a fixed axle, and the pulley 216 is mounted on a movable arm 220 which is pivotable about the fixed axle of the pulley 218. As best seen in FIG. 14, the third set of belts 120 and the escrow belts 156 are offset relative to the sixth set of belts 212 so as to avoid interference between the belts around the pulley rollers 216 and 218. A guide tab 222 is pivotally mounted on the axle of the pulley 216.

Similarly, the seventh set of belts 214 extend around lower pulley rollers 224 and 226, around which the fifth set of belts 132 and the escrow belts 156 also extend respectively. The pulley roller 224 is mounted on a movable arm 228 which is pivotable about the fixed axle of the pulley 226. The fifth set of belts 132 and the escrow belts 156 are offset relative to the seventh set of belts 214, in a similar manner to that shown in FIG. 14 for the sixth set of belts 212. The opposite ends of the arm 228 extend slightly beyond the pulleys 224 and 226 to provide additional guide surfaces (228*a*).

Figure 15:
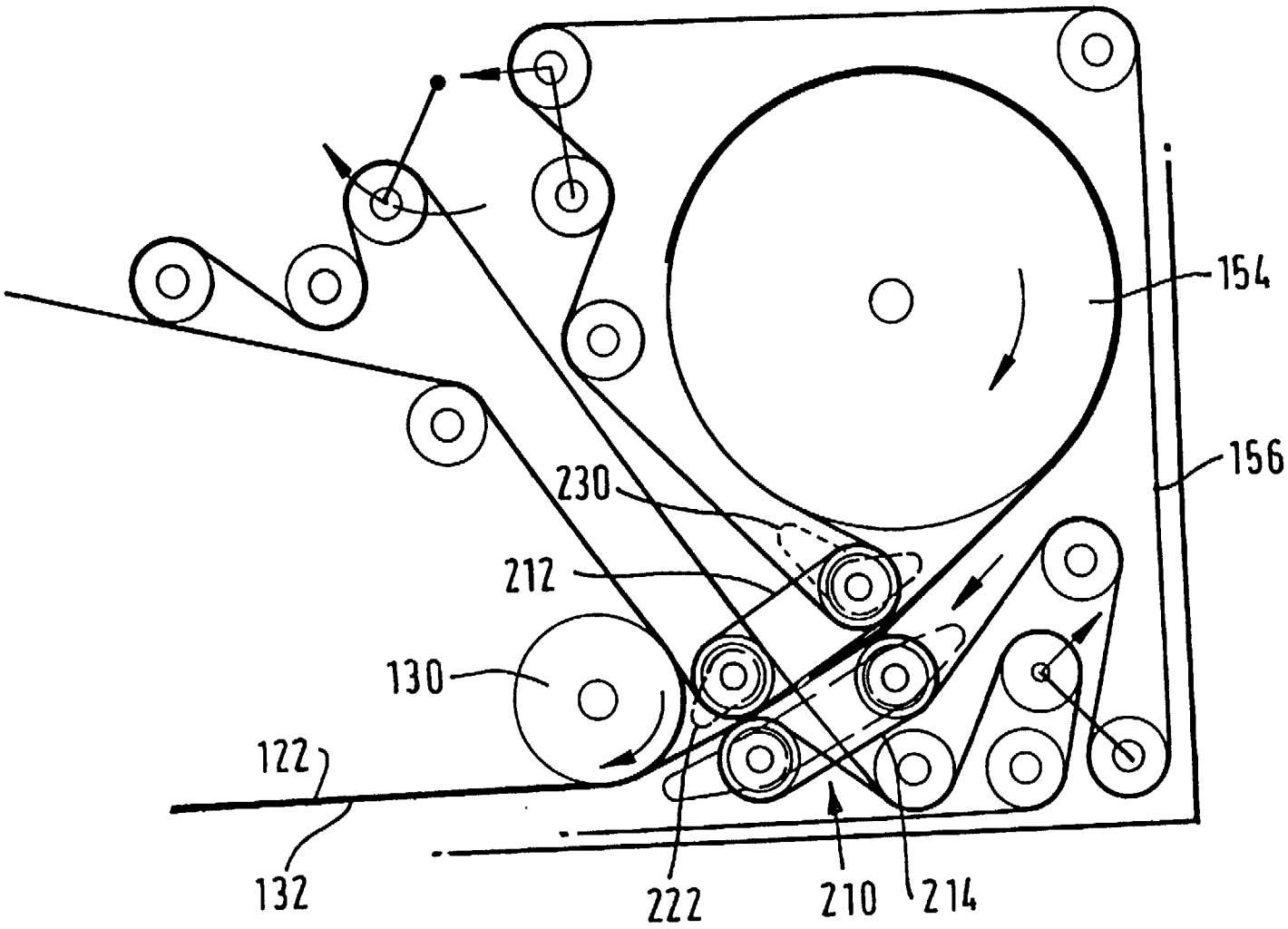

The switching device 210 is movable between an input position (as shown in FIG. 13) for receiving notes from the input section 102, and an output position (as shown in FIGS. 15) for delivering notes to the output section 106, the position of the switching device 210 being determined by an electro-mechanical actuator (not shown). In this embodiment, the switching device 210 is biased by a spring (not shown) towards its input position, which is statistically the most frequently used position of the switching device, and the actuator is used when it is desired to move the switching device 210 to the output position. However, in other embodiments, the switching device 210 could instead be biased in the other direction, or a two-way electro-mechanical actuator could be used.

It will be appreciated that movement of the switching device 210 causes changes in the lengths of the paths of the third and fifth sets of belts 120 and 132, respectively, and this is accommodated by providing respective tensioning pulleys 230 mounted on movable arms 232, biased by springs (not shown) in the directions shown to maintain a predetermined tension in the belts, in a similar manner to the pulley 174 for the escrow belts 156.

Referring to FIG. 13, a note transported from the input section 102 by the third and fourth belts, 120 and 122 respectively, approaches the switching device 210 in its input position. The pivotable guide tab 222 is positioned clear of the path of the approaching note, which is guided by the end 228*a* of the lower arm 228, between the sixth and seventh sets of belts, 212 and 214 respectively, towards the drum. As in the previous embodiment, the note is received between the escrow belts 156 and the surface of the drum 154 as the drum rotates anticlockwise. However, instead of being wound fully on to the drum 154, the note is stopped at an intermediate position (shown in FIG. 13) in which the tail end of the note is retained between the sixth and seventh sets of belts, 212 and 214 respectively, of the switching device 210.

The note is halted at the intermediate position until the sensor outputs in the input section 102 have been processed. If the note is determined to be acceptable, and the transaction may involve subsequent notes, then the note is loaded fully on the drum 104 by simply advancing the drum anticlockwise until the note is stored entirely between the drum 154 and the escrow belts 156. Alternatively, if the note is determined to be unacceptable, or if the single note can be encashed immediately, then the note is discharged from its intermediate position by moving the switching device 210 to the output position (see FIG. 15), and rotating the drum 154 in the clockwise direction. Since one end of the note is already engaged by the sixth and seventh belts, 212 and 214 respectively, there is no need for a guide member at this stage to lift the note off the surface of the drum 154. In the output position, the pivotable guide flap 222 is rotated to a position to guide the note downwardly from the switching device 210, until it is received between the fourth and fifth sets of belts, 122 and 132 respectively, which transport the note into the output section 106.

Figure 16:
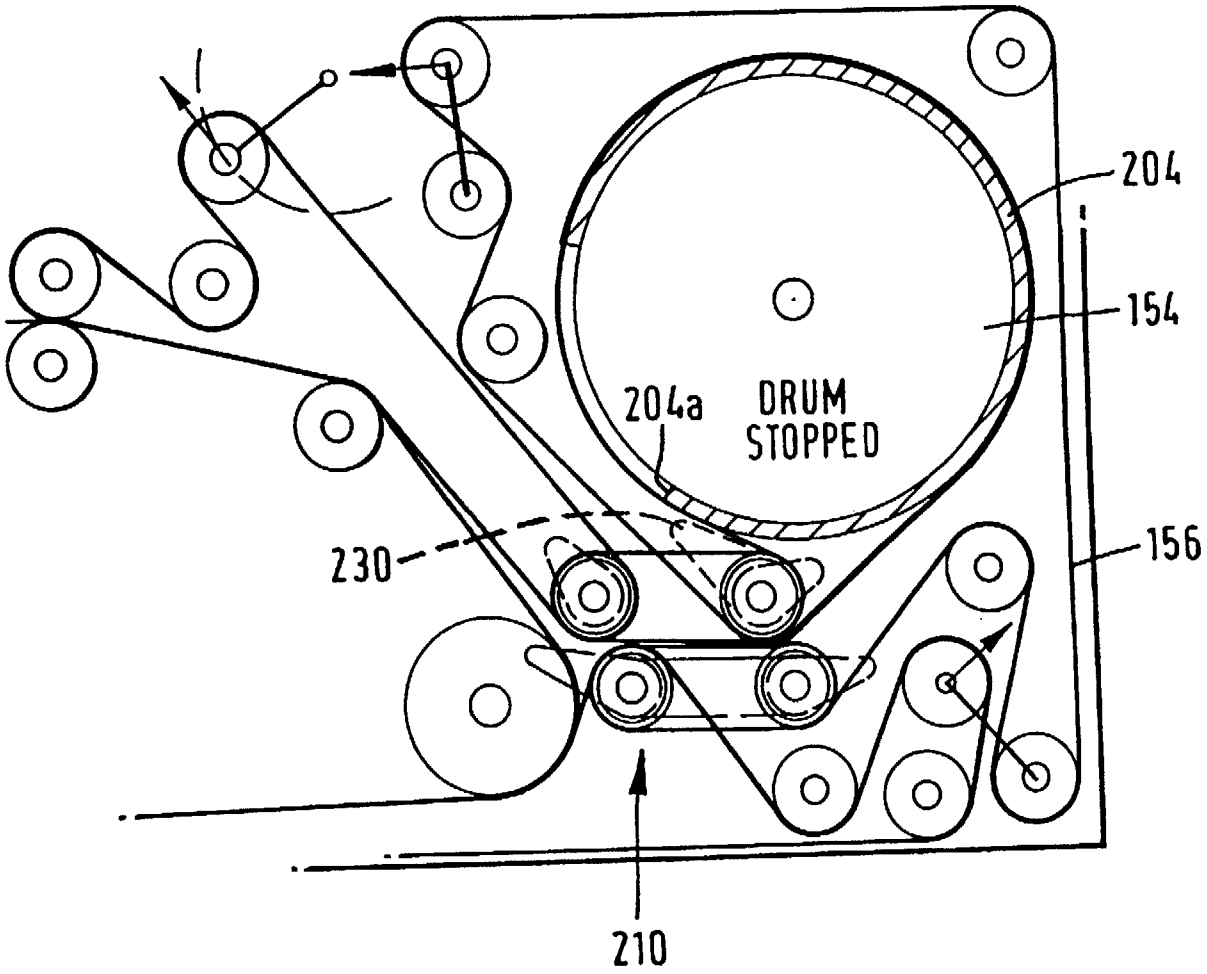

FIG. 16 illustrates the case in which a stack 204 of notes has already been accumulated on the drum 154, and a new note is introduced through the input section 102. The note is advanced through the switching device 210 in the same manner as described above until the note reaches the intermediate position (shown in FIG. 16).

From the intermediate position, the note can either be advanced fully on to the drum 154 to be superimposed fully on the stack 204, or the switch device 210 can be moved to the output position and the note discharged if the note is found not to be acceptable. Significantly, in the intermediate position, the tail end 204*a* of the stack 204 is retained captive between the escrow belts 156 and the drum 154. Consequently, if the drum 154 is rotated clockwise to discharge the partially wound note, this operation does not affect the stack 204 of previously stored notes which remain stored around the drum, i.e. the partially wound note can be discharged independently of the stack 204 of previously stored notes. There is thus no need for a guide member at this stage either to lift the new note from the stack 204, or to retain the remainder of the stack 204 on the surface of the drum 154.

Figure 17:
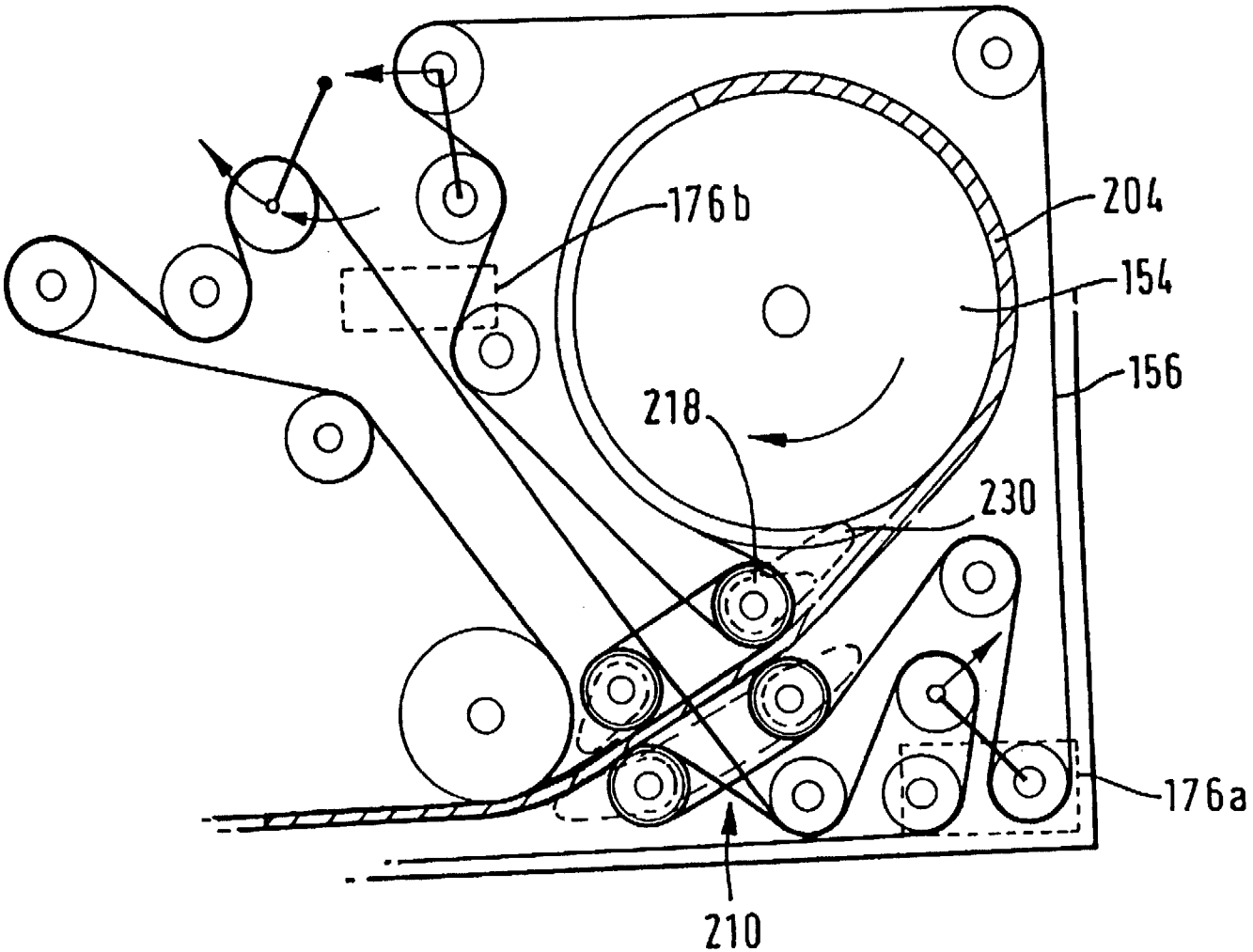

FIG. 17 illustrates how the stack 204 of notes is discharged when it is desired either to return the notes to the customer, or to encash the notes. To lift the stack 204 off the surface of the drum 154, the switching device 210 comprises movable guide fingers 230 pivotable about the axle of the pulley 218. The fingers 230 are movable between an active position, in which the fingers extend to the right as shown in FIG. 17, and a retracted position as shown in phantom in FIGS. 15 and 16. The fingers 230 are biased towards the retracted position by a spring (not shown), and are moved to the active position when needed only during the stack discharge operation, by a further electromechanical actuator (not shown). With the switching device 210 in the output position, the drum 154 is rotated clockwise to drive the stack 204 over the fingers 230 and through the switching device 210 to the output stage 106, from which the stack can either be returned to the customer or encashed, as explained hereinbefore.

In this embodiment, the electro-mechanically actuated fingers 230 are preferred to passive fingers of the type used in the previous embodiment, for the sake of reliability. It will be appreciated that, in the case shown in FIG. 16, if passive finger were used as in the previous embodiment, these fingers would bear against the stack 204 under the partially wound note, and the tip of the fingers might snag on the surface of the uppermost note in the stack 204 during clockwise rotation of the drum 154, which could result in a jam. The tendency for the tip to snag against a note is dependent on the physical condition of the note, and is increased if the note is holed or has a toughened surface or toughened edges, which may be the case in practice.

Figure 18:
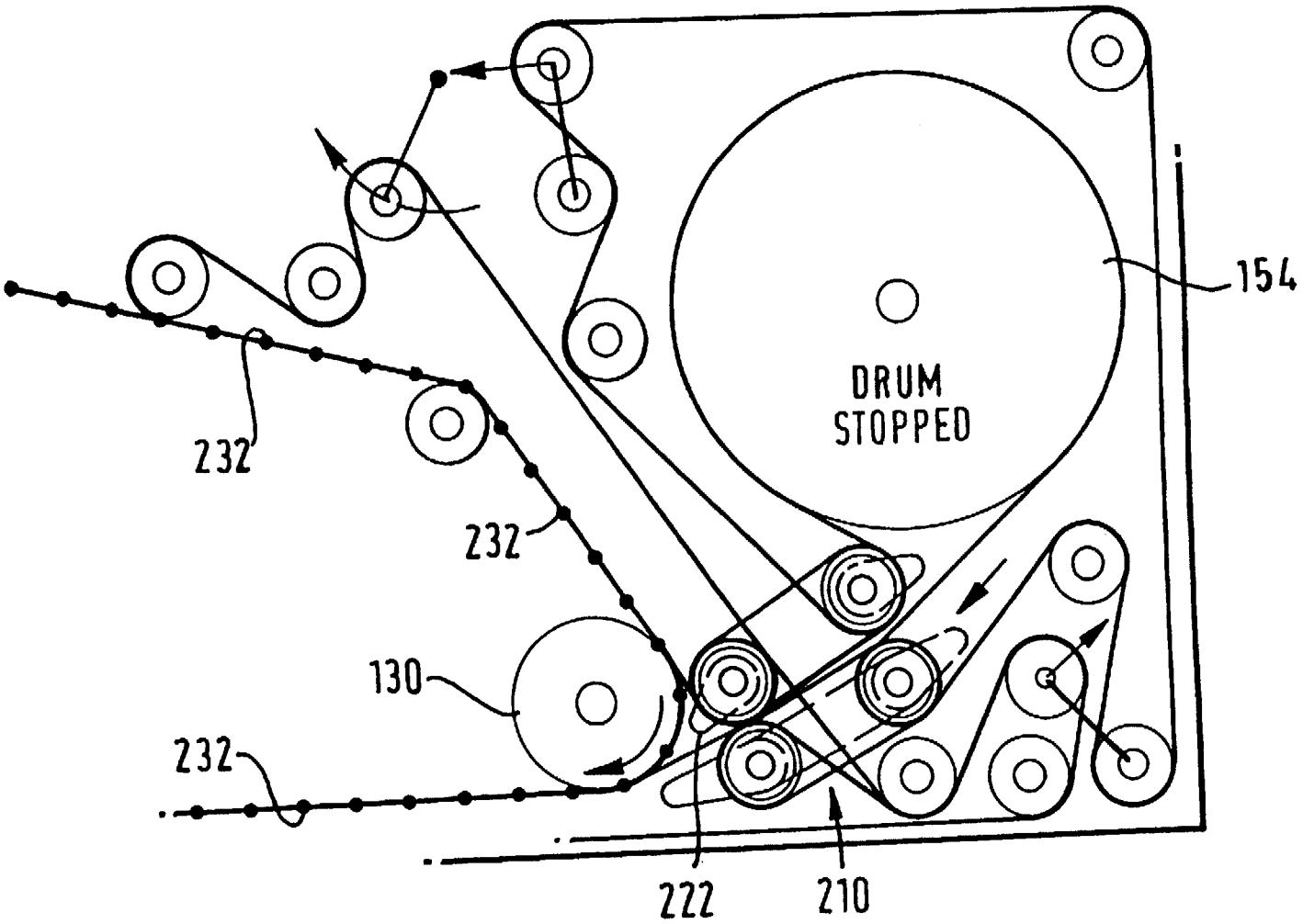

In contrast to the previous embodiment, each note introduced into the present embodiment is moved to the intermediate position on the drum 154 before the note has been validated. It is therefore necessary to protect the apparatus against the introduction of a long strip, or a note-on-a-string (i.e. a tethered note), which might otherwise be wound through more than one revolution on the drum 154, and possibly cause a jam. The protection is afforded by the sensors in the input section 102 which can provide an immediate indication if the inserted note is longer than a predetermined maximum expected length, or has a string attached. Referring to FIG. 18, in response to such an indication, the switching device 210 is moved downwardly to the output position, with the pivotable tab 222 being angled downwardly. In this position, the inserted object 232 is routed directly around the guide pulley 130 to the output section to be returned to the customer, without being wound on to the drum 154, and thus avoiding possible jamming or defrauding of the apparatus.

The driving force for moving the escrow belts 156 and rotating the drum 154 is provided from the main drive for the first, second, third, fourth and fifth sets of belts, in a similar manner to the previous embodiment. However, in contrast to the previous embodiment, these belts now move in the same direction when a note is introduced to the drum 154 as they do when the note is discharged from the drum 154; only the sixth and seventh sets of belts, 212 and 214 respectively, and the escrow belts 156 change the direction of their movement between these operations. Therefore, the apparatus employs two electro-mechanically operated clutches **176*a* and 176*b* to provide a driving force for the escrow belts 156 and for the sixth and seventh sets of belts, 212 and 214 respectively, selectively from two different pulleys or belts which move in opposite directions during the normal movement of the first, second, third, fourth and fifth sets of belts. For example, one clutch 176*a* may provide driving force from the fifth set of belts 132, and the other clutch may provide driving force in the opposite direction from the third set of belts 120**. Alternatively, a single clutch (not shown) could be used, and the direction of the driving force controlled by a electro-mechanical inverter gearbox for selectively reversing the direction of movement.

It will be appreciated the third set of belts 120 always move around the pulley 216 anticlockwise, and the fifth set of belts 132 always move around the pulley 224 anticlockwise, yet the direction of movement of the sixth and seventh sets of belts, 212 and 214 respectively, is reversible. This is accommodated by splitting the pulleys 216 and 224 into sections (FIG. 14), the sections **216*a* and 224*a* for the sixth and seventh sets of belts 212 and 214, respectively, being of slightly larger diameter than the sections 216*b* and 224*b* for the third and fifth sets of belts 120 and 132, respectively. The split sections of the pulleys allow for contrarotation, and the larger diameter of the sections 216*a* and 224*a* for the sixth and seventh sets of belts, 212 and 214 respectively, ensures that a note driven through the switching device 210 is always driven in the direction of movement of the sixth and seventh sets of belts 212 and 214, respectively, which move in unison with the escrow belts 156 and the drum 154**.

The embodiment shown in FIGS. 13–18 can be made just as compactly as the embodiment of FIGS. 8–12, and provides an additional speed advantage in the processing of the notes. In the previous embodiment, it takes around four seconds for a note to be moved to the intermediate position in the output section, and then "reversed" on to the drum if valid. This time appears to the customer as a four second delay before the next note can be inserted. However, in the present embodiment, an inserted note is advanced directly to the intermediate position in which it is partially wound on the drum 156. If then takes only a very short time to rotate the drum to completely wind the note, if the note is determined to be acceptable, which results in less of a delay before the next note can be inserted. However, this increase in speed is achieved at the expense of a more complex system of transportation belts, and a larger number of electro-mechanical actuators; separate actuators have to be provided for the switching device 210 and for the fingers 230, as well as for the two clutches **176*a* and 176*b***.

FIGS. 21–24 illustrate a modification of the design in FIGS. 13–18 in which a modified, simpler form of switching device **210*a* is used. In modified switching device 210*a*, the upper pulley 216 and the lower pulley 224 are mounted at fixed positions and a pivotable guide 238 is used to route notes between the input section 102, the output section 106, and the escrow 104*a*. The guide 238 consists of a flap pivoted about a central axis 239. The pivotable guide 222** is omitted in this design.

Figure 21:
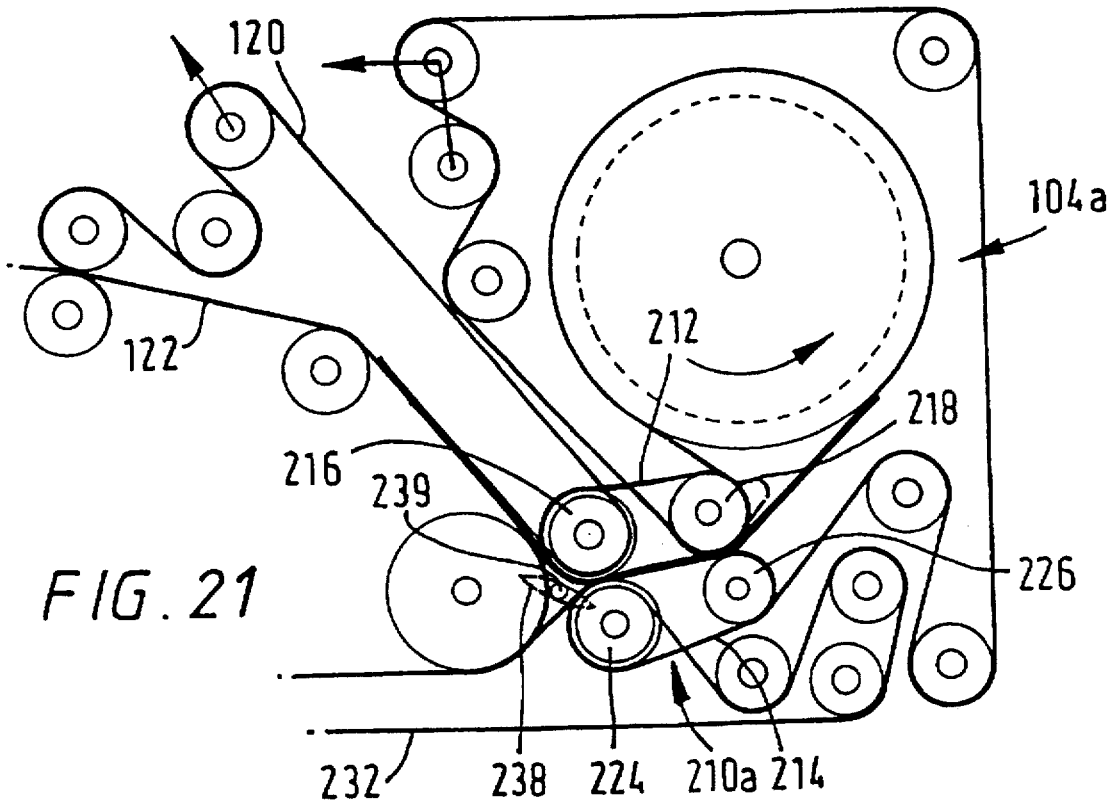
FIGS. 21–24 are schematic sectional views illustrating a modified form of switching device for use with the embodiment of FIG. 13.
Figure 22:
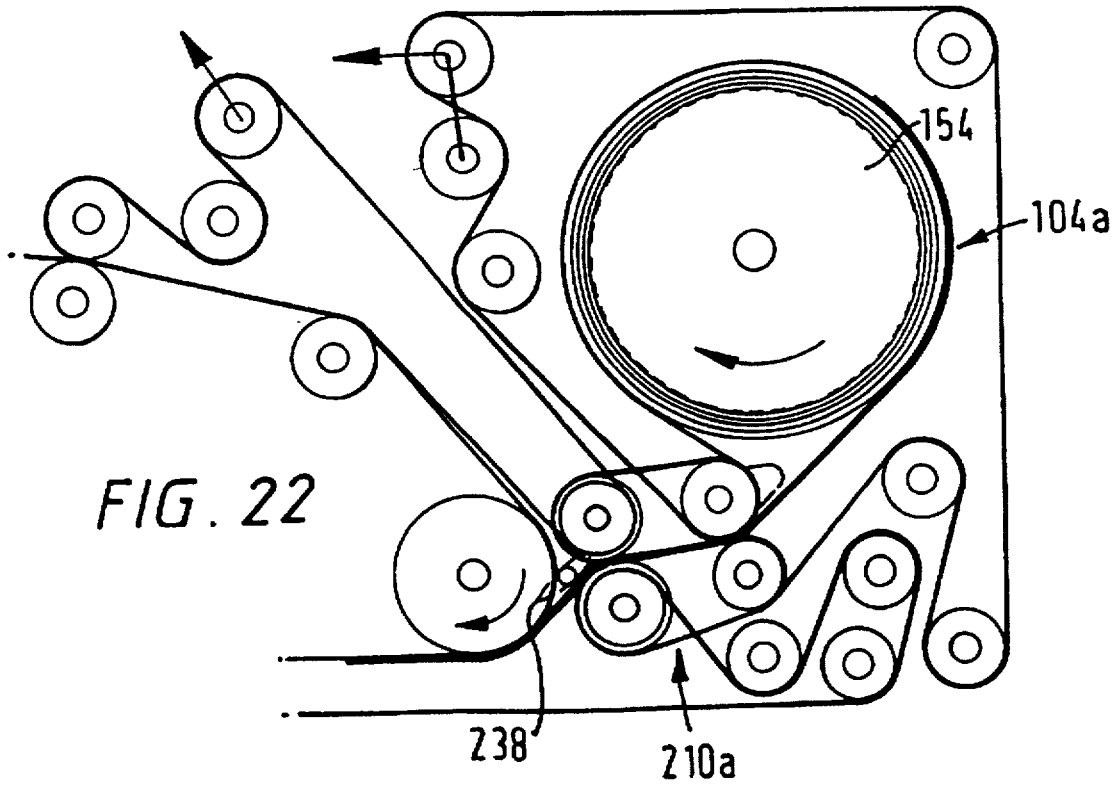
Figure 23:
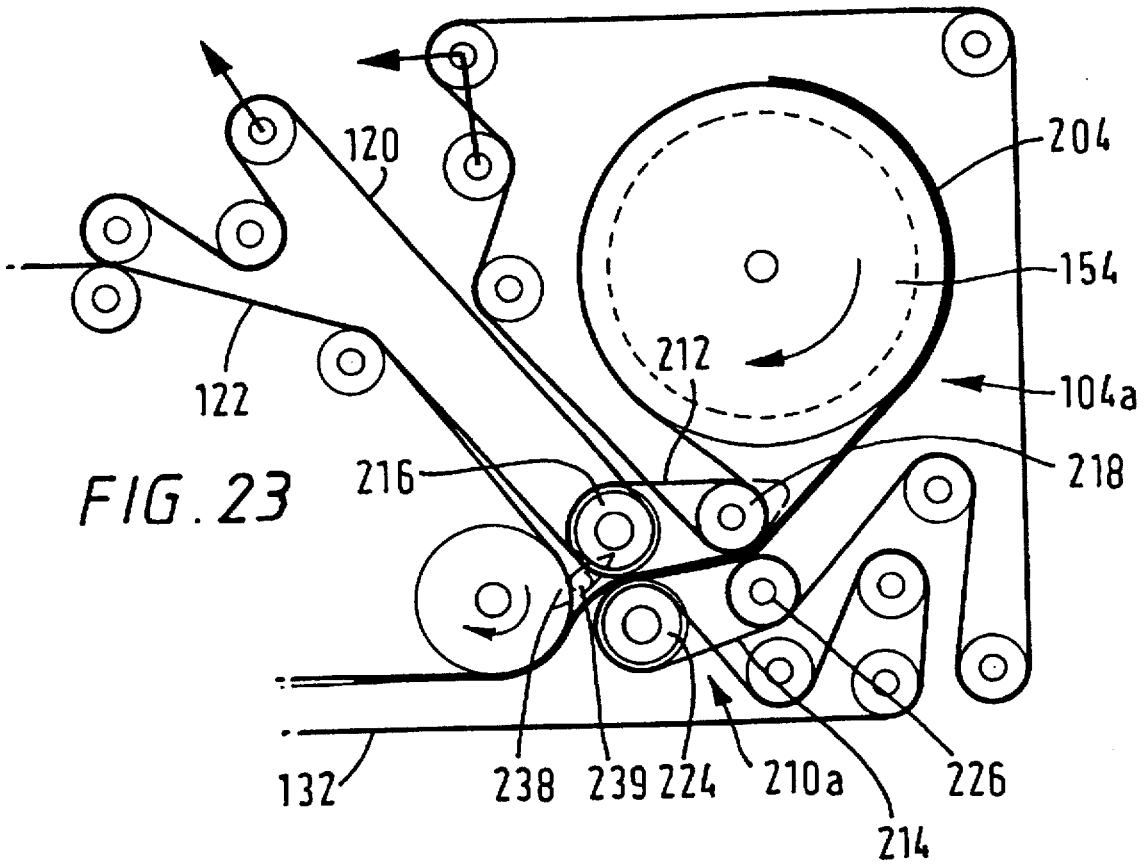
Figure 24:
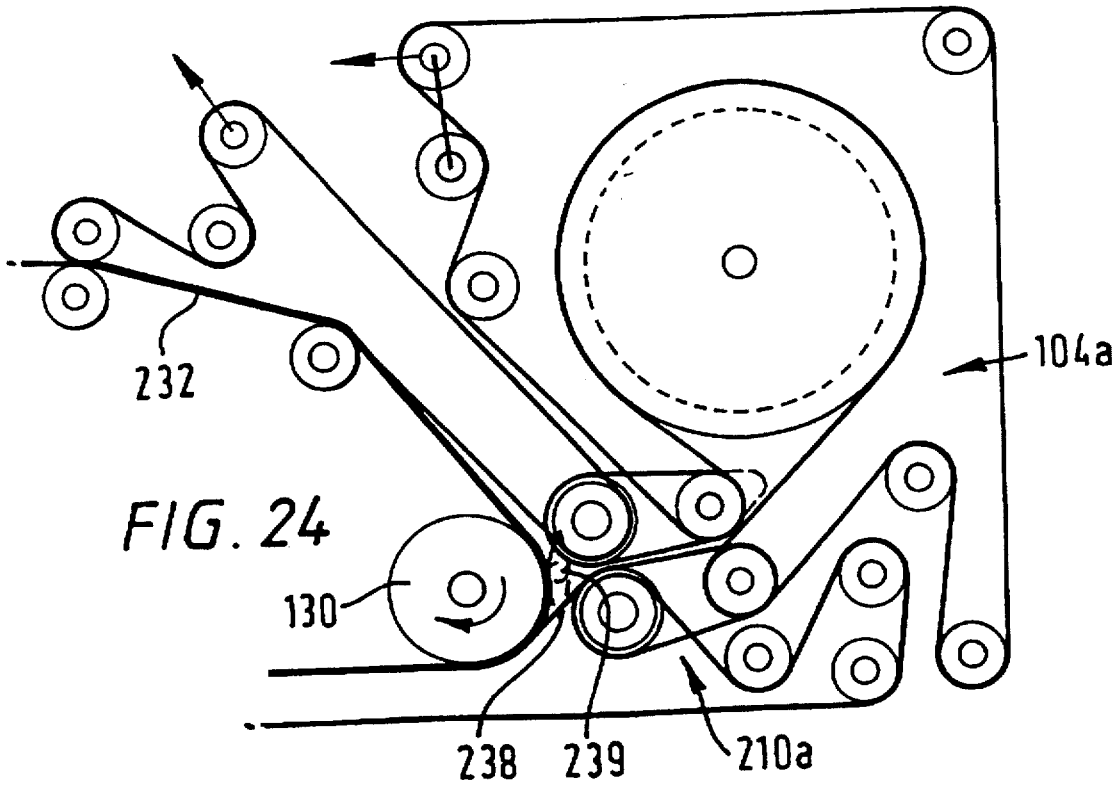

The guide 238 is movable between a first position (shown in FIG. 21), a second position (shown in FIGS. 22 and 23), and a third position (shown in FIG. The first position is used for routing a note arriving from the input section 102 to the escrow **104*a* (see FIG. 21). The second position is used for guiding a single note discharged from the partially stored position (see FIG. 22) to the output section 106, and also for guiding an entire stack 204 when discharged from the escrow (see FIG. 23) to the output section 106. The third position is used for guiding a sheet 232 directly from the input section 102 to the output section 106 (see FIG. 24) if the sheet 232 is detected to be too long. It will be appreciated that with this modified design, the switching device is simpler, as the belts 212, 214, 120 and 132 do not need to articulate. The position of the guide 238** is controlled by an electro-mechanical actuator (not shown).

Figure 19:
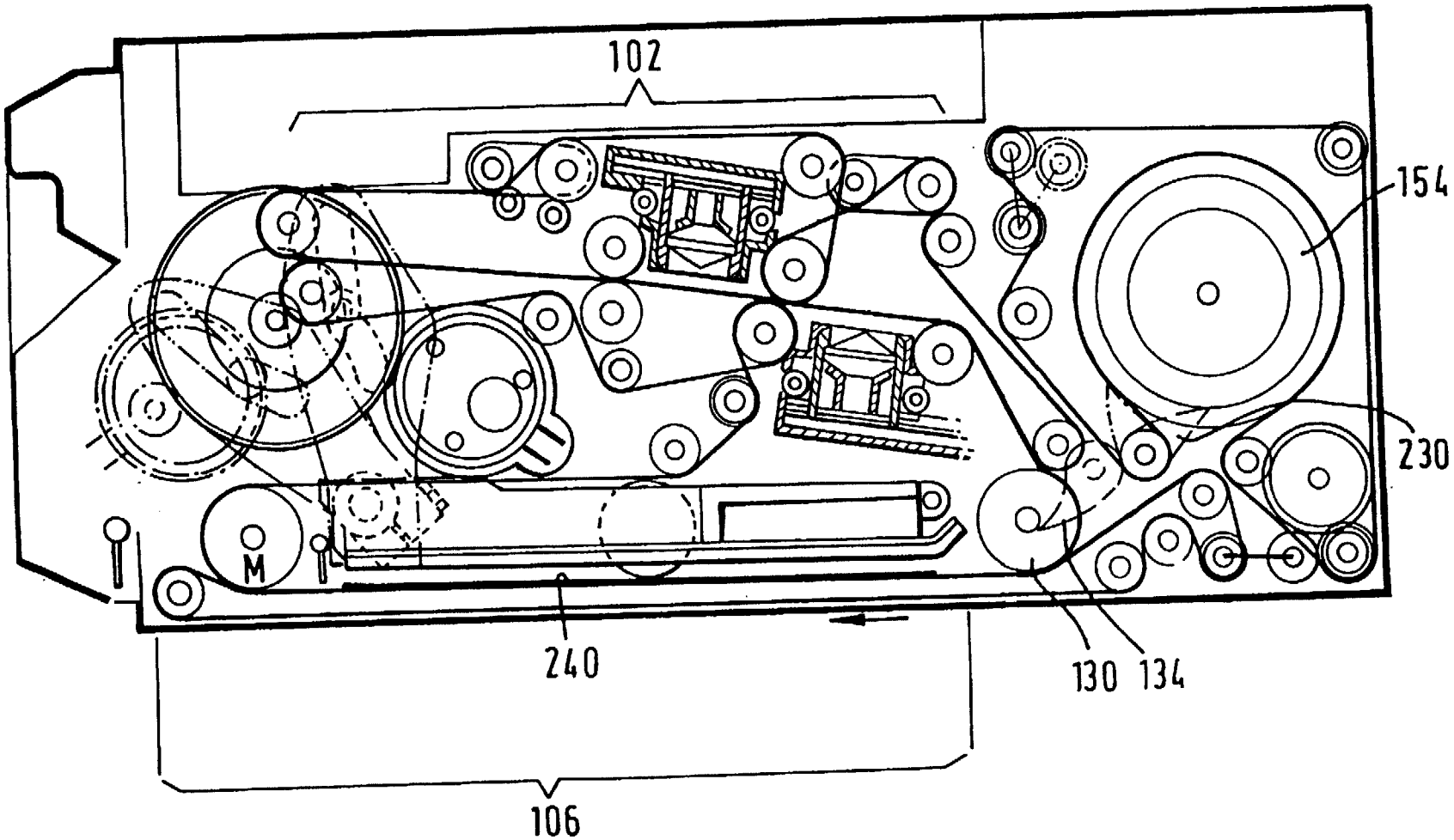
FIG. 19 is a schematic sectional view through a third modified embodiment.

FIG. 19 illustrates schematically a further embodiment which is, in effect, a hybrid of the embodiment in FIGS. 8 to 12, and the embodiment in FIGS. 13 to 18. In FIG. 19, a note introduced through the input section 102 is routed past the passive movable guide 134 to a first intermediate position 240 in the output section 106. If the note is detected to be either too long or to have a string attached, the note is immediately returned to the customer through the exit slot, otherwise the note is immediately "reversed" from the output section 106 to a second intermediate position in which it is partially wound on the drum 154. The note is halted in the second intermediate position until the sensor outputs from the input section have been processed to identify the denomination of the note. From the second intermediate position, the note can either be wound fully on to the drum 154, or it can be returned to the output section 106 for return to the customer or for encashing. The switching fingers 230 are provided for lifting an accumulated stack from the drum 154 when the stack is to be returned to the customer or encashed.

The above embodiments utilise separate input and output sections, 102 and 106 respectively, as each section can be adapted for the direction of movement of the note, for example, past the sensors in the input section. This is preferred to enable the note to be moved rapidly without risk of jamming, and it is commonly believed that such systems, although more expensive, are advantageous in this respect over bidirectional systems which use only a single entry/exit slot.

Figure 20:
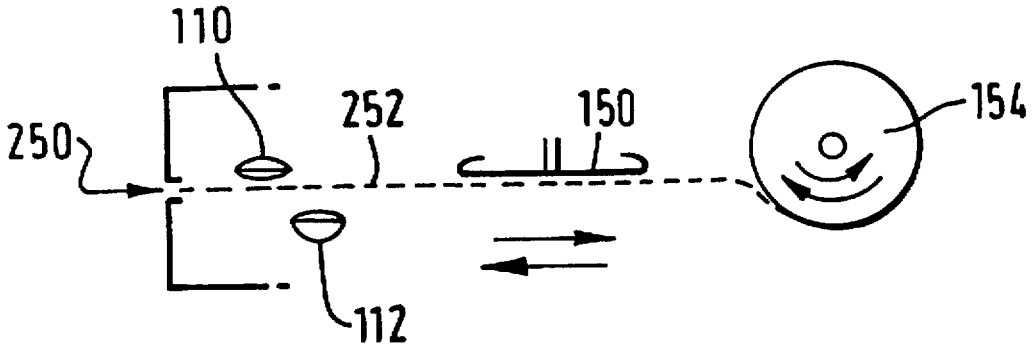
FIG. 20 is a schematic view illustrating a fourth embodiment.

FIG. 20 illustrates low-cost bidirectional system incorporating an escrow drum 154. A single entry/exit slot 250 is used, and the path of the note is shown by the broken line 252. The two sensors 110 and 112 are positioned adjacent to the entry/exit slot 250, and the stacker piston 150 is arranged downstream of the sensors 110 and 112, before the escrow drum 154. In use, a note introduced through the slot 250 is transported past the two sensors 110 and 112 to an intermediate position at which the note is held until the outputs of the sensors have been processed to determine whether the note is acceptable. The intermediate position can either be under the stacker piston 150, or it can be when the note is partially wound on the drum 154. In the former case, a passive guide can be used to discharge notes from the drum 154 on reverse rotation, but in the latter case an active guide such as the set of guide fingers 230 is preferred.

Whilst specific embodiments of the invention have been described in detail, it will be appreciated that many modifications and developments may be made without departing from the spirit or scope of the invention defined in the appended claims.

We claim:

1. Sheet handling apparatus comprising:

input path means for receiving sheets inputted to the apparatus;

first output means for outputting a rejected sheet;

second output means for outputting an accepted sheet;

a temporary storage device for storing temporarily one or more sheets in the apparatus to allow processing of additional sheets; and transportation means operable to transport a sheet from the input path means to an intermediate position at which the sheet can selectively be outputted by either the first output means or the second output means without fully placing the sheet in the temporary storage device, or the sheet can be selectively stored by the temporary storage device, wherein said transportation means is operable selectively to reverse the direction of movement of the sheet when moving the sheet out of the intermediate position.

2. Apparatus according to claim 1, further comprising output path means for guiding said sheet for output by either said first output means or said second output means, wherein said intermediate position of said sheet is a position in said output path means.

3. Apparatus according to claim 2, wherein said transportation means is operable to move said sheet in a first direction of movement of the sheet to said intermediate position in said output path, and said transportation means is selectively operable to reverse the direction of movement of said sheet to transport the sheet to said temporary storage device.

4. Apparatus according to claim 2, wherein said transportation means comprises means for guiding a sheet from the input path means substantially along a U-turn path to said intermediate position in said output means.

5. Sheet handling apparatus comprising:

input path means for receiving sheets inputted to the apparatus;

first output means for outputting a rejected sheet;

second output means for outputting an accepted sheet;

a temporary storage device for storing temporarily one or more sheets in the apparatus to allow processing of additional sheets; and transportation means operable to transport a sheet from the input path means to an intermediate position wherein the intermediate position is a position in which the sheet is stored partially by the temporary storage device, and can be discharged from the partially stored position without discharging sheets already stored by the temporary storage device, and wherein at which the sheet can selectively be outputted by the second output means without outputting any additional sheet stored by the temporary storage device, or the sheet can be selectively stored by the temporary storage device.

6. Apparatus according to claim 5, wherein the temporary storage device comprises cylindrical means having a circumferential periphery around which one or more sheets can be stored, and endless belt means extending around a major portion of the circumference of the cylindrical means for holding said one or more sheets against the cylindrical means, said endless belt means leaving clear an entry/exit region through which notes can be introduced to or discharged from the cylindrical means upon rotation of the cylindrical means, the intermediate position being a position in which a first portion of said sheet in said intermediate position is received around said cylindrical means, and a second portion of said sheet is retained clear of said cylindrical means in said entry/exit region.

7. Apparatus according to claim 6, wherein said cylindrical means is rotatable in a first direction for moving said sheet to said intermediate position, and is rotatable in a second direction of rotation for discharging said sheet from said intermediate position for output by said first or second output means.

8. Apparatus according to claim 5, further comprising sensor means for sensing the length of the sheet, and the transportation means comprises means for moving the sheet to the intermediate position only if the length of the sheet is acceptable, the transportation means being operable to transport the sheet directly to the first output means if the length of the sheet is not acceptable.

9. Apparatus according to claim 5, wherein said temporary storage device comprises rotatable cylindrical means around which one or more sheets can be stored, and endless belt means extending around a major portion of the circumference of the cylindrical means for holding said one or more sheets against the cylindrical means, said endless belt means leaving clear an entry/exit region through which sheets can be introduced to, or discharged from the cylindrical means, upon rotation of the cylindrical means.

10. In a sheet handling apparatus, a temporary storage device for storing one or more sheets fed successively to the storage device and operable to return the sheets in an accumulated bundle, the storage device being operable selectively to return the most recently fed sheet individually from the storage device without returning any sheet fed previously and stored by the storage device.

11. A storage device according to claim 10, wherein the device comprises means operable to receive a most recently fed sheet in a partially stored condition, from which the sheet can be discharged individually.

12. A storage device according to claim 11, comprising means for carrying one or more notes stored by the storage device, and wherein the partially stored condition is a condition in which a first portion of the sheet is carried by the carrying means or for the stored notes, and a second portion is retained clear of the carrying means.

13. A storage device according to claim 12, wherein the carrying means comprises cylindrical means having a cylindrical periphery around which notes can be stored.

14. A storage device according to claim 10, wherein the storage device is an escrow for storing value sheets.

15. In a sheet handling apparatus, a temporary storage device comprising:

cylindrical means having a circumferential periphery around which sheets can be stored;

endless belt means extending around a major portion of the circumference of the cylindrical means for holding said sheets against the cylindrical means, said endless belt means leaving clear an entry/exit region through which one or more sheets can be introduced to, or discharged from, the cylindrical means;

drive means for rotating the cylindrical means in a first direction when one or more sheets are to be introduced to the cylindrical means, and in a second direction when one or more sheets are to be discharged from the cylindrical means; and control means operable to control the drive means to rotate the cylindrical means in the first direction to receive a sheet introduced to the cylindrical means, and to halt rotation of the cylindrical means in the first direction at a partially stored position in which a first portion of the sheet is received around the cylindrical means and a second portion of the sheet remains clear of the cylindrical means in the entry/exit area.

16. A temporary storage device according to claim 15, wherein the control means is operable selectively to control the drive means to recommence rotation of the cylindrical means in the first direction to store the sheet on the cylindrical means at a position clear of the entry/exit region.

17. A temporary storage device according to claim 15, wherein the control means is operable selectively to control the drive means to rotate the cylindrical means in the second direction of rotation to discharge the partially stored sheet from the cylindrical means without discharging any additional sheet which may already be stored around the cylindrical means.

18. In a sheet handling system, a storage device for storing one or more sheets temporarily, the storage device comprising:

cylindrical means having a circumferential periphery around which sheets can be stored;

endless belt means extending around a major portion of the circumference of the cylindrical means for holding said sheets against the cylindrical means, said endless belt means leaving clear an entry/exit region through which one or more sheets can be introduced to, or discharged from, the cylindrical means;

drive means for rotating the cylindrical means in a first direction when one or more sheets are to be introduced to the cylindrical means, and in a second direction when one or more sheets are to be discharged from the cylindrical means;

guide means biased, during rotation of the cylindrical means in both the first direction and the second direction, to a return position in the entry/exit region in which position the guide means co-operates with sheets approaching in the second direction of rotation to guide the sheets off the surface of the cylindrical means for discharge through the entry/exit region and, during rotation of the cylindrical means in the first direction, the guide means is displaced out of the return position by contact with one or more sheets on the cylindrical means to allow the sheets on the cylindrical means to pass, and the guide means returning to the return position under said bias once the sheets have been moved therepast; and a sensor for sensing the position of the guide means, and for providing an electrical signal indicative of the sensed position.

19. A storage device according to claim 18, wherein in order to determine a discharge position of the cylindrical means, the drive means is operable to rotate the cylindrical means in the first direction until the sensor switch indicates that the guide means is in the return position.

20. A storage device according to claim 19, wherein the drive means is further operable to rotate the cylindrical means in the second direction to discharge sheets stored on the cylindrical means, once the sensor switch has indicated that the guide means is in the return position for guiding sheets off the cylindrical means.

21. A storage device according to claim 18, wherein the guide means comprises at least one tip which, in the return position of the guide means, is positioned relative to the cylindrical means so that the tip is received under one or more sheets approaching in the second direction of rotation, to thereby lift the sheets from the surface of the cylindrical means.

22. A storage device according to claim 21, wherein the cylindrical means comprises at least one generally annular clearance, the tip of the guide means being received in the clearance when in the return position.

23. A storage device according to claim 22, wherein the cylindrical means comprises a plurality of annular clearances, and the guide means comprises a plurality of guide fingers receivable in the clearances.

24. A storage device according to claim 18, wherein the guide means bears against the cylindrical means when in the return position.

25. A storage device according to claim 18, wherein the cylindrical means comprises a drum having one or more surface recesses for receiving the guide means when in the return position.

26. A storage device according to claim 18, wherein the guide means is pivotable about a predetermined axis which extends substantially parallel to the axis of rotation of the cylindrical means.

27. A storage device according to claim 18, wherein the guide means includes an abutment portion for bearing against sheets on the cylindrical means when in the displaced position to prevent the sheets from fanning out while in the entry/exit region.

28. In a sheet handling system, a storage device for storing one or more sheets temporarily, the storage device comprising:

cylindrical means having a circumferential periphery around which sheets can be stored;

endless belt means extending around a major portion of the circumference of the cylindrical means for holding said sheets against the cylindrical means, said endless belt means leaving clear an entry exit region through which one or more sheets can be introduced to, or discharged from, the cylindrical means;

drive means for rotating the cylindrical means in a first direction when one or more sheets are to be introduced to the cylindrical means, and in a second direction when one or more sheets are to be discharged from the cylindrical means;

tactile means displaceable by contact with sheets in at least one direction of rotation of the cylindrical means, for sensing the presence of sheets at a certain position around the cylindrical means;

a sensor for sensing the condition of the tactile means, and for providing an electrical signal indicative of the sensed condition.

29. A storage device according to claim 28, wherein the tactile means is positioned so as to detect the presence of notes in the entry/exit region.

30. A storage device according to claim 28, wherein the tactile means comprises movable guide means biased, during rotation of the cylindrical means in both the first direction and the second direction, to a return position in the entry/exit region in which position the guide means co-operates with sheets approaching in the second direction of rotation to guide the sheets off the surface of the cylindrical means for discharge through the entry/exist region and, during rotation of the cylindrical means in the first direction, the guide means is displaced out of the return position by contact with one or more sheets.

31. A short-term storage device for sheets comprising an intermediate storage device having a mouth opening, and a transportation system for feeding the sheets through the mouth opening; the intermediate storage device comprising:

a drum rotatable about a drum axis and having a cylindrical surface, a set of parallel endless belts which is laid from the outside at one side around the cylindrical surface of the drum, the belts serving to hold the sheets stored in a bundle fast on the drum, a switching device having tongues which are pivotable about a pivot axis against the cylindrical surface for lifting the bundle off the cylindrical surface upon return of the bundle to the transportation system, a drive unit for the drum, plurality of sensors, and a control device which is designed at least for controlling the drive unit by means of signals from the sensors, wherein the drive unit for the drum and for the endless belts can be switched over into opposite first and second directions of rotation, the drum being designed for storage of the sheets which are individually fed through the mouth opening by way of a passage by means of a single complete revolution of the drum through 360° in the first direction of rotation so that successively stored sheets form a bundle, and return of the bundle which is stored on the cylindrical surface being effected by way of the same passage through the mouth opening, wherein the drum performs a single complete revolution through 360° in the second direction of rotation, and wherein the drive unit comprises a stepping motor which is electrically connected to the control device by way of a plurality of lines, the control device being arranged to determine the direction of rotation and the moment at which the drive unit is switched on, and to switch off the drive unit after a 360° rotary movement in the determined direction of rotation.

32. The short-term storage device of claim 31, wherein the drive unit includes a coupling connected to the control device by way of a plurality of lines and a mechanical transmission for coupling to the transportation system, the control device being arranged to determine the time at which the coupling is engaged and to disengage the coupling after a 360° rotary movement in the first or second direction of rotation.

33. The short-term storage device of claim 32, wherein the transportation system comprises upper and lower endless belts, the drive unit being designed to make a direct frictional connection between upper endless belts of the transportation system and the endless belts of the intermediate storage device.

34. The short-term storage device of claim 31, wherein the tongues have ends which bear resiliently under a spring force in a radial direction against the drum, the tongues which are rotatable about the pivot axis having a spring element for producing the spring force.

35. The short-term storage device of claim 31 or claim 34, wherein the drum has groove-like depressions in the cylindrical surface and the tongues have ends which are disposed in the groove-lie depressions in order to avoid damage to the sheets in the switching device upon return of the bundle.

36. The short-term storage device of claim 31, wherein the set of endless belts are in contact with the cylindrical surface of the drum over at least 270° of the periphery thereof.

37. A method of controlling a rotatable intermediate sheet storage device around which sheets can be stored, comprising:

rotating the storage device in a first direction to receive a sheet being fed thereto;

halting rotation of the storage device in the first direction at a position in which a first portion of the sheet is received around the storage device, and a second portion of the sheet remains clear of the storage device, whereby the sheet can either be stored on the storage device with any previously stored sheets by continuing rotation of the storage device in the first direction, or the sheet can be discharged from the storage device independently of any previously stored sheets by reversing the rotation of the storage device.

38. A method of handling value sheets in a value sheet handling apparatus, said apparatus comprising an input, a temporary storage device for temporarily storing one or more value sheets to allow processing of further value sheets, a path from said input to said temporary storage device and an intermediate position on said path, the method comprising:

transporting the sheets successively from said input to said intermediate position and then selecting one of the following operations and performing the selected operation:

(a) sending the sheet to be stored at said temporary storage device with previously entered sheets;

(b) encashing the sheet without fully delivering the sheet to the storage device; and (c) returning the sheet without returning sheets stored in the storage device.

39. An apparatus for controlling a rotatable intermediate sheet storage device around which sheets can be stored, comprising:

means for rotating the storage device in a first direction to receive a sheet being fed thereto;

means for reversing rotation of the storage device; and means for halting rotation of the storage device in the first direction at a position in which a first portion of the sheet is received around the storage device, and a second portion of the sheet remains clear of the storage device, whereby the sheet can either be stored on the storage device with any previously stored sheets by continuing rotation of the storage device in the first direction, or the sheet can be discharged from the storage device independently of any previously stored sheets by reversing the rotation of the storage device.

40. A value sheet handling apparatus comprising:

means for transporting the sheet from an input to an intermediate position;

means for sending the sheet along a first route from the intermediate position to, and storing the sheet in a temporary storage device with previously entered sheets;

means for selectively sending the sheet along a second route from the intermediate position to encash the sheet, without fully delivering the sheet to the storage device;

means for sending the sheet along a third route from the intermediate position to return the sheet without returning the sheets stored at the storage device.

41. Banknote handling apparatus comprising:

a first note passage for receiving a banknote inputted to the apparatus;

a second note passage for outputting a banknote from the apparatus;

a third note passage for accepting a banknote;

a temporary storage device for storing temporarily one or more banknotes in the apparatus to allow processing of additional banknotes, and for accumulating notes thereat to form a stack, the temporary storage device comprising a rotatable cylindrical element around which one or more sheets can be stored, and at least one endless belt extending around a major portion of the circumference of the cylindrical element for holding said one or more sheets against the cylindrical element, the endless belt leaving clear a bidirectional entry/exit region through which the banknotes can be introduced to, and discharged from, the cylindrical element upon rotation of the cylindrical element; and a transportation system operable selectively to:

(a) transport an inputted banknote from the first passage to an intermediate position in the transportation system at which the banknote is in direct communication with the second passage, the third passage and the entry/exit region adjacent to the cylindrical element;

(b) transport a banknote in a first movement direction from the intermediate position through the entry/exit region to transfer the banknote to the cylindrical element for temporary storage with any banknotes already stored on the cylindrical element;

(c) transport banknotes stored on the cylindrical element in a second movement direction opposite to said first movement direction through said entry/exit region to said intermediate position in said transportation system to unload the banknotes as a stack from the cylindrical element;

(d) transport one or more banknotes located at the intermediate position through said second passage to output the banknotes to a user; and (e) transport one or more banknotes located at the intermediate position through said third passage to accept said banknotes.

42. Apparatus according to claim 41, wherein the cylindrical element is rotatable in a first rotation direction when a sheet is to be fed to the cylindrical element, and in a second rotation direction when one or more sheets are to be discharged from the cylindrical element.

43. Apparatus according to claim 42, further comprising drive means for driving the transportation means in first and second transportation directions of movement, and a selectable transmission coupling for selectively coupling a driving force to the cylindrical element for rotating the cylindrical element in the first rotation direction when the transportation means is driven in one transportation direction, and for rotating the cylindrical element in the second rotation direction when the transportation means is driven in the other transportation direction.

44. Apparatus for handling sheets comprising:

a temporary storage device comprising a rotatable cylindrical element around which one or more sheets can be stored, and at least one endless belt extending around a major portion of the circumference of the cylindrical element for holding said one or more sheets against the cylindrical element, the endless belt leaving clear an entry/exit region through which sheets can be introduced to, and discharged from, the cylindrical element upon rotation of the cylindrical element;

a transportation system comprising at least one movable transport element for engaging a sheet to transport the sheet to and from the temporary storage device, and a drive unit for driving the transport element; and a selectable transmission coupling for selectively coupling a driving force from the transportation system to the temporary storage device to rotate the cylindrical element.

45. Apparatus as defined in claim 44, further comprising an electronic control unit coupled to the drive unit and to the selectable transmission coupling for controlling the apparatus in a first operating mode in which the cylindrical element rotates with operation of the transportation system, and in a second operating mode in which the transportation system is operated with rotating the cylindrical element.

46. Apparatus according to claim 44, wherein the drive unit is coupled by a fixed coupling to the transportation system for driving the transportation element.

47. Apparatus according to claim 44, wherein the selectable transmission coupling comprises selectable coupling means for coupling the storage device to the drive unit through the transportation means.

48. Apparatus according to claim 44, wherein the drive unit operates in the same direction during an operation to feed a sheet to the storage device as it does during an operation to feed a sheet from the storage device, the apparatus further comprising a selectable reversing device for selectively reversing the direction of the driving force coupled to the storage device by the selectable transmission coupling.

49. Apparatus according to claim 44, wherein the drive unit operates in the same direction during an operation to feed a sheet to the storage device as it does during an operation to feed a sheet from the storage device, and the selectable transmission coupling means comprises first and second selectable couplings, the first selectable coupling being operable to provide a driving force in one direction to operate the storage device when a sheet is to be fed to the storage device, and the second selectable coupling being operable to provide a driving force in the opposite direction to operate the storage device when a sheet is to be fed from the storage device.

50. Apparatus according to claim 44, wherein the drive unit and the selectable transmission coupling are operable to rotate the cylindrical element in a first direction of rotation when a sheet is to be introduced to the cylindrical element for at least partial storage by the cylindrical element, and in a second direction of rotation when a sheet stored at least partially by the cylindrical element is to be discharged from the cylindrical element.

51. Apparatus according to claim 50, wherein the drive unit and the selectable transmission coupling are operable to rotate the cylindrical element in the first direction to store a sheet fed thereto by the transportation system at a position on the cylindrical element in which it is placed on top of any previously introduced sheets already stored on the cylindrical element, and is stored at a position clear of said entry/exit area.

52. Apparatus according to claim 44, wherein the drive unit and the selectable transmission coupling are operable to halt a sheet fed thereto by the transportation means in a partially stored condition in which a first portion of said sheet is received around the cylindrical element, and a second portion of said sheet remains clear of said cylindrical element in said entry/exit region.

53. Apparatus according to claim 44, wherein the selectable transmission coupling is operated by at least one electro-mechanical actuator.

54. Sheet handling apparatus comprising:

a temporary storage device for sheets comprising rotatable cylindrical means around which one or more sheets can be stored, and endless belt means extending around a major portion of a circumference of the cylindrical means for holding the sheets against the cylindrical means;

transportation means for transporting a sheet along a note path; and control means for operating said transportation means in a first movement direction to advance a received sheet to an intermediate position in said note path, and for selectively reversing the direction of movement of the transportation means to move said note from the intermediate position in a reverse direction to transfer the sheet to the temporary storage device.

* * * * *